US008398300B2

(12) United States Patent
Chan

(10) Patent No.: US 8,398,300 B2
(45) Date of Patent: Mar. 19, 2013

(54) WEARABLE ARTICLE

(75) Inventor: Siu Ming Raymond Chan, Hong Kong (HK)

(73) Assignee: Chung Nam Watch Company Limited, Hong Kong (HK)

( * ) Notice: Subject to any disclaimer, the term of this patent is extended or adjusted under 35 U.S.C. 154(b) by 422 days.

(21) Appl. No.: 12/868,872

(22) Filed: Aug. 26, 2010

(65) Prior Publication Data

US 2012/0020193 A1 Jan. 26, 2012

(30) Foreign Application Priority Data

Jul. 26, 2010 (HK) ..... 10107144.8

(51) Int. Cl.
*G04B 19/04* (2006.01)
*G04B 37/00* (2006.01)

(52) U.S. Cl. ..... 368/280; 368/276; 368/281; 368/297

(58) Field of Classification Search ..... 368/76, 368/80, 88, 223, 276, 277, 281, 285, 297, 368/300, 309
See application file for complete search history.

(56) References Cited

U.S. PATENT DOCUMENTS 5,047,998 A * 9/1991 Aizawa et al. ..... 368/75
5,161,130 A * 11/1992 Sato et al. ..... 368/228
5,844,863 A 12/1998 Voss et al. ..... 368/88
5,850,373 A * 12/1998 Lee ..... 368/65
6,229,768 B1 * 5/2001 Nakazawa et al. ..... 368/223
6,388,953 B1 * 5/2002 Wu ..... 368/76
7,480,213 B2 * 1/2009 Muraji ..... 368/223

FOREIGN PATENT DOCUMENTS

| | | | |
|---|---|---|---|
| CN | 2461028 | Y | 11/2001 |
| CN | 2496058 | Y | 6/2002 |
| CN | 2657053 | Y | 11/2004 |
| CN | 201017187 | Y | 2/2008 |
| CN | 101246352 | A | 8/2008 |
| EP | 1 291 738 | | 3/2003 |
| JP | 2002-228768 | | 8/2002 |

OTHER PUBLICATIONS

Hong Kong Search Report dated Aug. 11, 2010 with English translation.

* cited by examiner

*Primary Examiner* — Vit W Miska
(74) *Attorney, Agent, or Firm* — Ostrolenk Faber LLP

(57) ABSTRACT

A watch (100, 200, 300) is disclosed as including a case and a rotation module (106, 206, 306) with a longitudinal axis (L-L, N-N, P-P), in which the rotation module (106, 206, 306) is contained within the case and freely rotatable relative to the case about the longitudinal axis (L-L, N-N, P-P), the rotation module (106, 206, 306) including a number of movement parts (134, 234, 334), and, upon rotation of the rotation module (106, 206, 306) relative to the case, the movement parts (134, 234, 334) are each movable relative to the rotation module (106, 206, 306) and to-and-fro along a respective path ($L_{m1}$-$L_{m1}$, $L_{m2}$-$L_{m2}$, $L_{m3}$-$L_{m3}$, $L_{m4}$-$L_{m4}$, $N_{m1}$-$N_{m1}$, $N_{m2}$-$N_{m2}$, $N_{m3}$-$N_{m3}$, $N_{m4}$-$N_{m4}$, $P_{m1}$-$P_{m1}$, $P_{m2}$-$P_{m2}$, $P_{m3}$-$P_{m3}$, $P_{m4}$-$P_{m4}$).

27 Claims, 30 Drawing Sheets

WEARABLE ARTICLE

BACKGROUND OF THE INVENTION

This invention relates to a wearable article, which may be worn or carried by a user.

In the jewelry industry and fashion accessory industry, wearable articles have been made available in which the articles may present or carry a pattern, figure, picture or image which may best be viewed when the article is in a certain orientation relative to the viewer. To facilitate reading of the time of a watch (which is also a wearable article), the watch should be placed in an orientation relative to the viewer to enable him/her to view the watch face in a certain direction, e.g. from the 6-o'clock position towards the 12-o'clock position generally. However, when the article is not placed in a proper viewing orientation, the article has to be moved relative to the viewer, or the wearer may even have to move himself/herself to allow the pattern, picture, figure or image presented or carried by the article to be properly viewed.

SUMMARY OF THE INVENTION

It is thus an object of the present invention to provide a wearable article in which the aforesaid shortcoming, or at least to provide a useful alternative to the trade and public.

According to the present invention, there is provided a wearable article including a case, and a body with a longitudinal axis, wherein said body is contained within said case and freely rotatable relative to said case about said longitudinal axis of said body, wherein said body includes at least one movement element, and wherein, upon rotation of said body relative to said case, said at least one movement element is movable to-and-fro along a path and relative to said body.

Embodiments of the present invention will now be described, by way of examples only, with reference to the accompanying drawings, in which:

BRIEF DESCRITPION OF THE DRAWINGS

DESCRIPTION OF PREFERRED EMBODIMENTS

Figure 1:
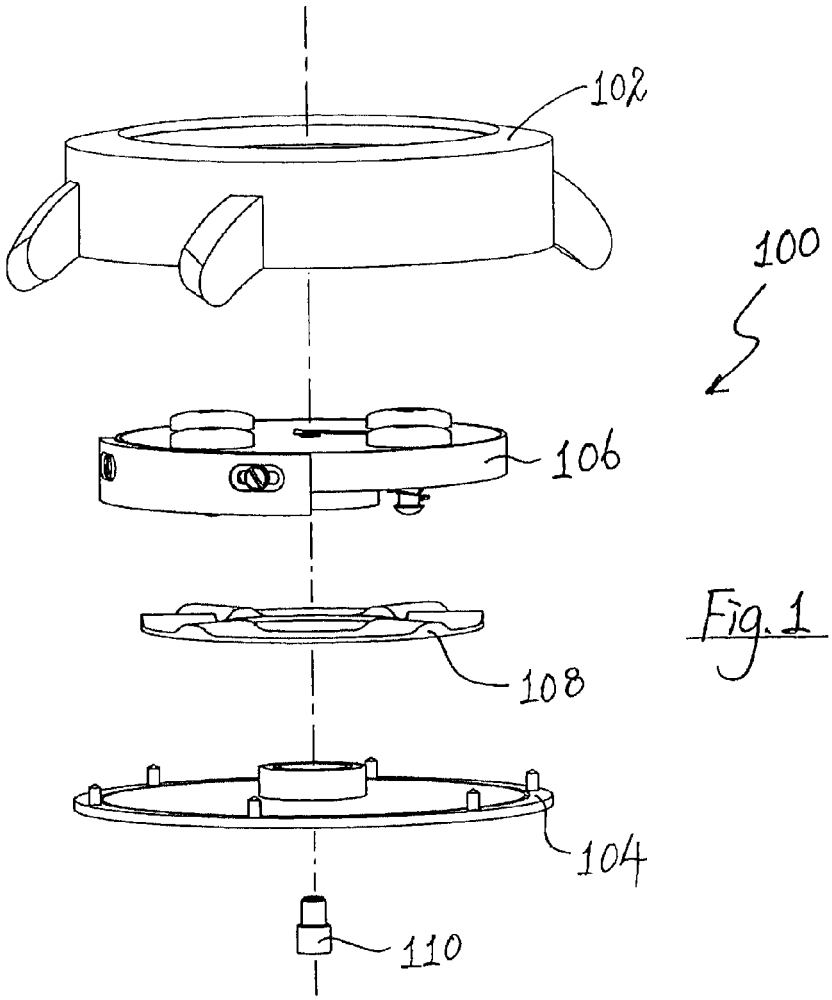
FIG. 1 is an exploded perspective view of a watch, being a wearable article, according to a first embodiment of the present invention.
Figure 2:
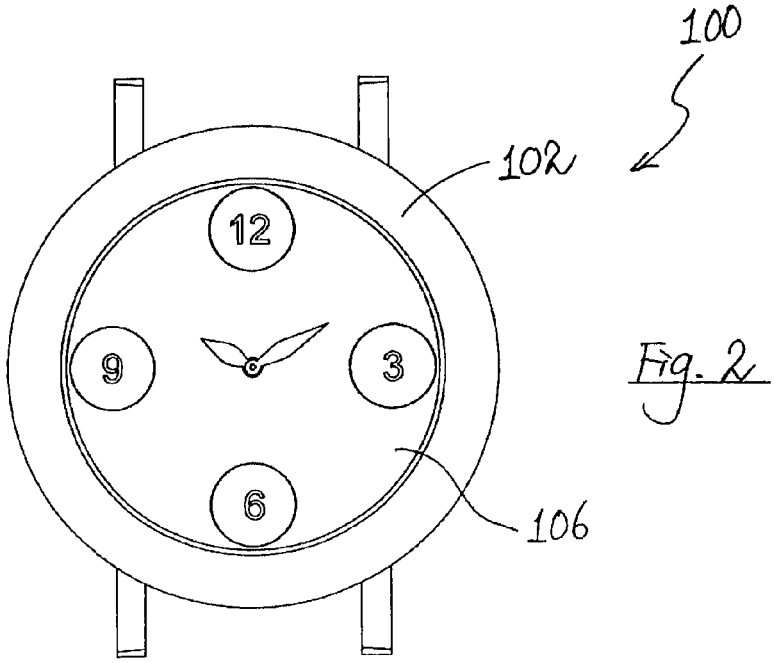
FIG. 2 is a top view of the watch of FIG. 1.

FIG. 1 shows various components of a watch, being a wearable article, according to a first embodiment of the present invention, in which the watch is generally designated as 100, and FIG. 2 shows a top view of the watch 100.

The watch 100 includes a case body 102 and a case back 104 which are engageable with each other to form a watch case with a cylindrical interior cavity. A generally cylindrical rotation module 106 and an annular cam 108 are contained within the cylindrical interior cavity of the watch case formed by the case body 102 and case back 104. The cam 108 is fixedly attached to the case back 104 and thus to the watch case. A time adjustment pusher 110 is also provided, which is operable to allow setting and adjustment of the watch movement (to be discussed below) in the rotation module 106.

Figure 3:
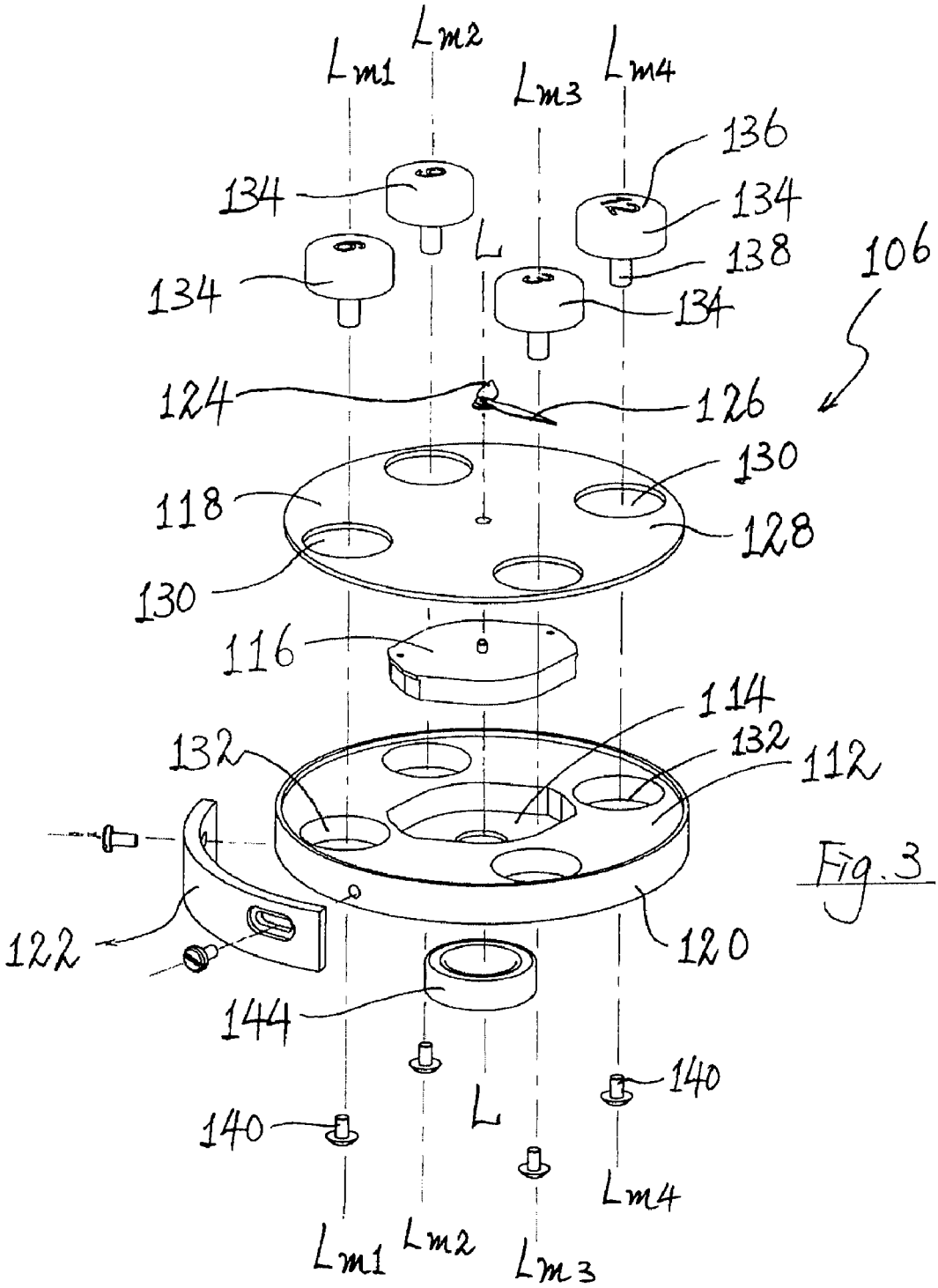
FIG. 3 is an exploded perspective view of a rotation module in the watch of FIG. 1.

Turning to FIG. 3, such shows various components of the rotation module 106. The rotation module 106 includes a base 112 with a cavity 114 within which a watch movement 116 is placed. A watch dial 118 is engaged with and on the base 112 and to contain the watch movement 116. The watch movement 116 is thus movable simultaneously with the watch dial 118 and the base 112.

To an outer periphery 120 of the base 112 is mounted an arc-shaped weight 122. The weight 122 causes the centre of gravity of the rotation module 106 to be away (i.e. offset) from a central longitudinal axis L-L of the rotation module 106. The watch movement 116 is engaged with an hour hand 124 and a minute hand 126 which travel closely to a watch face 128 of the watch dial 118. The weight 122 is mounted to the outer periphery 120 of the base 112 such that it is symmetrical about the six o'clock position. By way of this arrangement, the centre of gravity of the rotation module 106 is on a plane which contains both (a) the central longitudinal axis L-L of the rotation module 106 and (b) a line joining a point on the central longitudinal axis L-L of the rotation module 106 and the six o'clock position of the watch dial 118.

The watch dial 118 has four circular through-holes 130 which, when the watch dial 118 is assembled with the base 112, are aligned with four circular through-holes 132 in the base 112. The rotation module 106 also carries four movement parts 134. Each of the four movement parts 134 is marked with a respective numeral, such that the movement parts 134 can act as numeral pads to co-operate with the hour hand 124 and minute hand 126 for indication of time. Of course, the movement parts 134 may be marked with other patterns, ornaments, figures or images, or even not marked with anything. Each movement part 134 has a generally cylindrical head 136 and a pin 138. The holes 130, 132 are sized and configured to be slightly larger than the cylindrical head 136 of the movement part 134 so as to allow the movement part 134 to move relative to the base 112 (and thus the rotation module 106). In particular, each of the movement parts 134 is movable relative to the base 112 and to-and-fro along its respective longitudinal axis $L_{m1}$-$L_{m1}$, $L_{m2}$-$L_{m2}$, $L_{m3}$-$L_{m3}$, $L_{m4}$-$L_{m4}$ which is parallel to the central longitudinal axis L-L of the rotation module 106.

Although in the above illustrated example, the path along which each movement part 134 may move to-and-fro and relative to the rotation module 106 is parallel to the central longitudinal axis L-L of the rotation module 106, it is apparent that the path along which each movement part 134 may move to-and-fro may be inclined relative to the central longitudinal axis L-L of the rotation module 106, e.g. by 30°, 45° or 60°. In addition, although the above example illustrates that the path along which each movement part 134 moves relative to the rotation module 106 is straight, it is envisaged that such a path may be curved.

A respective pin 138 of each movement part 134 is engaged with a screw 140 and with a spring 142 (see FIG. 4) between them. A bearing 144 is also provided.

Figure 4:
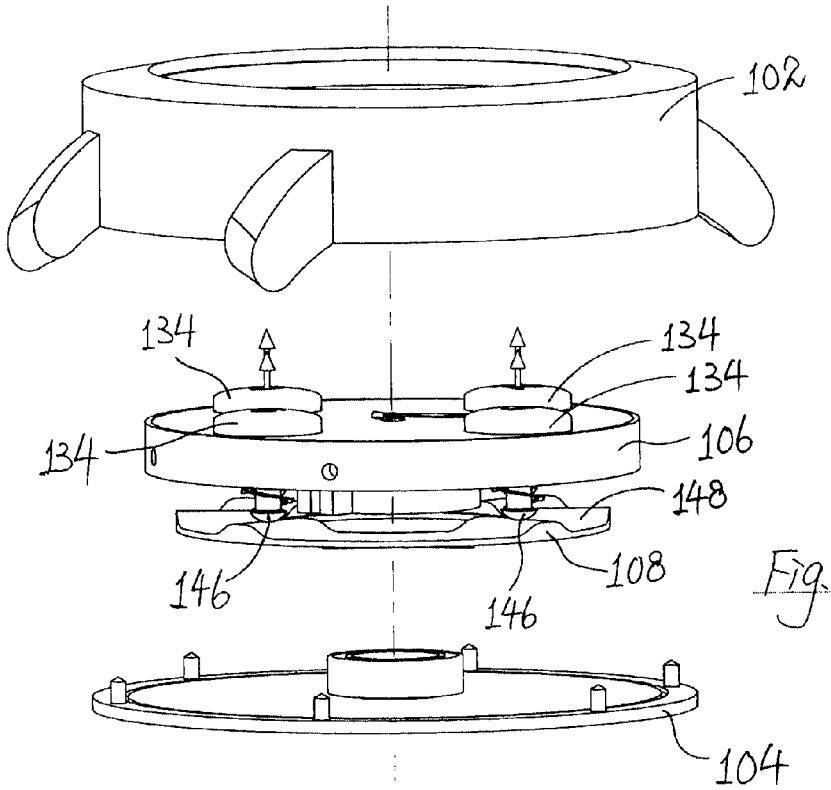
FIG. 4 is an exploded perspective view of the watch of FIG. 1 in which the rotation module is at a first position relative to a case of the watch.

Turning now to FIG. 4, it can be seen that the rotation module 106 rests on the cam 108 which is fixedly engaged with the case back 104. When the watch 100 is duly assembled, thanks to the bearing 144 disposed between the rotation module 106 and the case back 104, the rotation module 106 is freely rotatable relative to the case back 104 (and thus the watch case formed by the case body 102 and the case back 104) about the longitudinal axis L-L in both clockwise and anti-clockwise direction through at least up to 360°.

Figure 6:
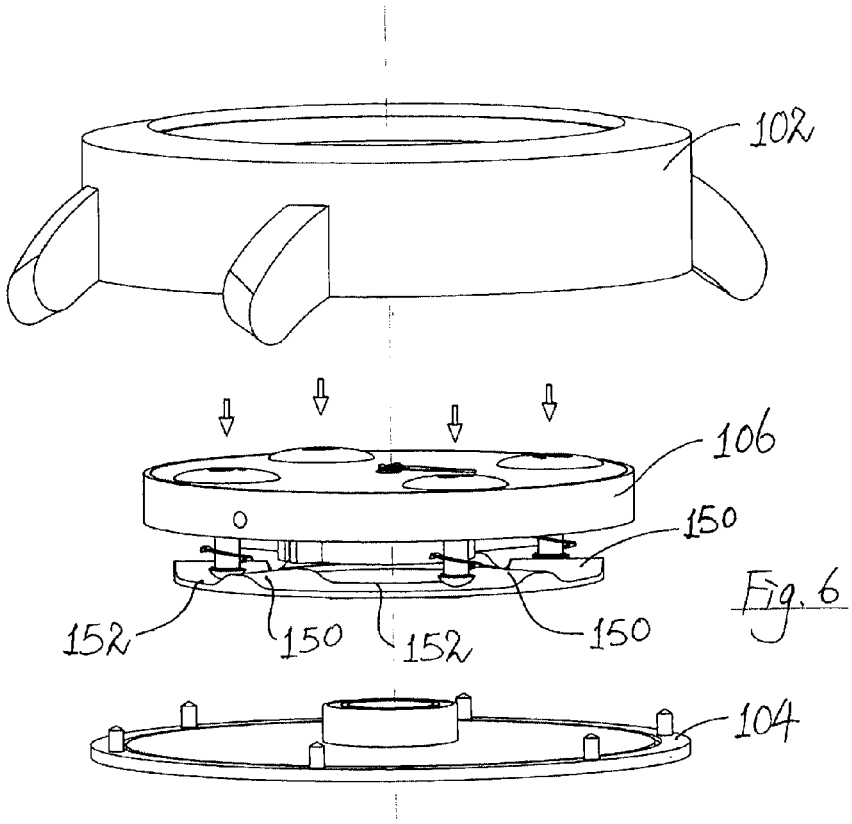
FIG. 6 is an exploded perspective view of the watch of FIG. 4 in which the rotation module is at a second position relative to the case.

During rotation of the rotation module 106 relative to the cam 108 and the case back 104, a lower end 146 of each of the screw 140 engages and travels on an undulating cam surface 148 of the cam 108. The movement parts 134 thus constitute followers of the cam 108. When viewed from above, the cam surface 148 is also annular in shape. On the other hand, when viewed from the side, it can be seen that the cam surface 148 has a number of crest portions 150 and intervening trough portions 152 (see FIG. 6). The cam 108 has a central longitudinal axis which, when the rotation module 106 is duly assembled, coincides with the central longitudinal axis L-L of the rotation module 106. The crest portions 150 may be equiangularly disposed along the cam surface 148 of the cam 108. Alternatively, the crest portions 150 may be disposed along the cam surface 148 of the cam 108 in other manners, e.g. irregularly. It should also be understood that the crest portions 150 may be of different distances from the bottom surface of the cam 108 (which is the major surface of the cam 108 opposite to the cam surface 148). In addition, the trough portions 152 may also be of different distances from the bottom surface of the cam 108.

Figure 5:
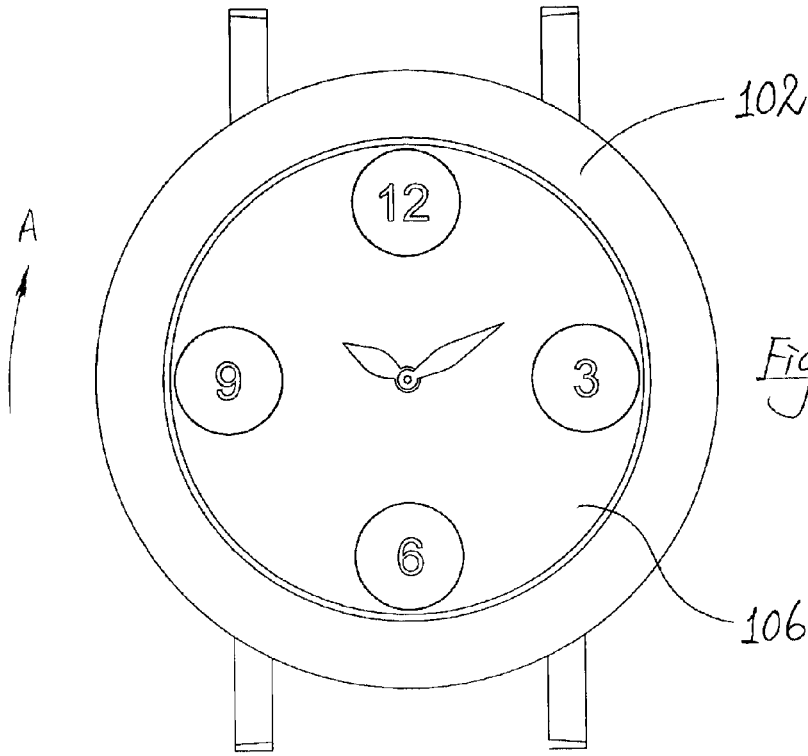
FIG. 5 is a top view of the watch of FIG. 4.

In FIGS. 4 and 5, the rotation module 106 is disposed relative to the case body 102 (and thus the case) of the watch 100 in a first position. In this position, all four movement parts 134 carried by the rotation module 106 sit on a respective crest portion 150 of the cam surface 148 of the cam 108, and the movement parts 134 are in an upper position relative to the watch face 128 of the watch dial 118 of the rotation module 106.

If the watch 100 is moved, the rotation module 106 may be caused to rotate relative to the watch case. In particular, if the longitudinal axis L-L of the rotation module 106 is not vertical, a part of the outer periphery 120 of the base 112 will be closer to the ground than other parts of the outer periphery 120. As the centre of gravity of the rotation module 106 is offset from its central longitudinal axis L-L, the rotation module 106 will rotate about the longitudinal axis L-L relative to the watch case to a position in which the weight 122 is closest to the ground.

For the subsequent discussion relating to the watch 100, we will take the scenario in which the rotation module 106 rotates about the longitudinal axis L-L relative to the case body 102 in a direction indicated by the arrow A in FIG. 5 (i.e. in the clockwise direction).

Figure 7:
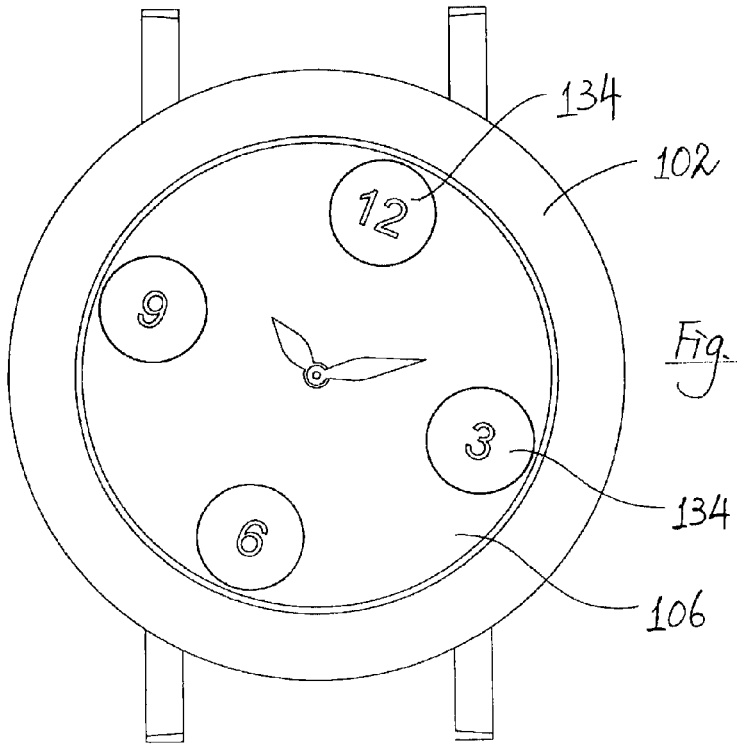
FIG. 7 is a top view of the watch of FIG. 6.
Figure 8:
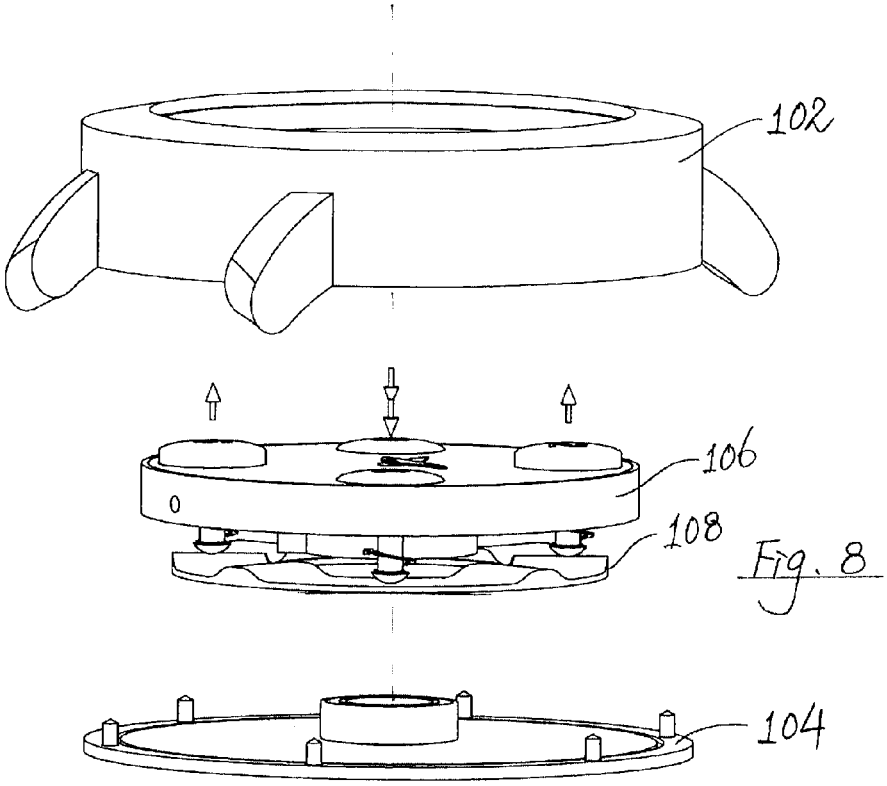
FIG. 8 is an exploded perspective view of the watch of FIG. 4 in which the rotation module is at a third position relative to the case.

During movement of the rotation module 106 relative to the case body 102 from the position shown in FIG. 5 to the position shown in FIG. 7, the movement parts 134 travel on, along and relative to the cam surface 148 of the cam 108. When the rotation module 106 is in the position shown in FIG. 7 relative to the case body 102, all four movement parts 134 carried by the rotation module 106 sit on a respective trough portion 152 of the cam surface 148 of the cam 108, and the movement parts 134 are in a lower position relative to the watch face 128 of the rotation module 106. Thus, during rotation of the rotation module 106 from the position shown in FIG. 5 to the position shown in FIG. 7, all four movement parts 134 move in the same direction, namely towards the case back 104, as indicated by the arrows in FIG. 6. It can also be noted that, during rotation of the rotation module 106 relative to the case body 102, each movement part 134 exhibits both a rotational movement relative to the case body 102 (and thus the watch case) about the central longitudinal axis L-L of the rotation module 106 and a linear to-and-fro movement along its respective central longitudinal axis $L_{m1}$-$L_{m1}$, $L_{m2}$-$L_{m2}$, $L_{m3}$-$L_{m3}$, $L_{m4}$-$L_{m4}$.

Figure 9:
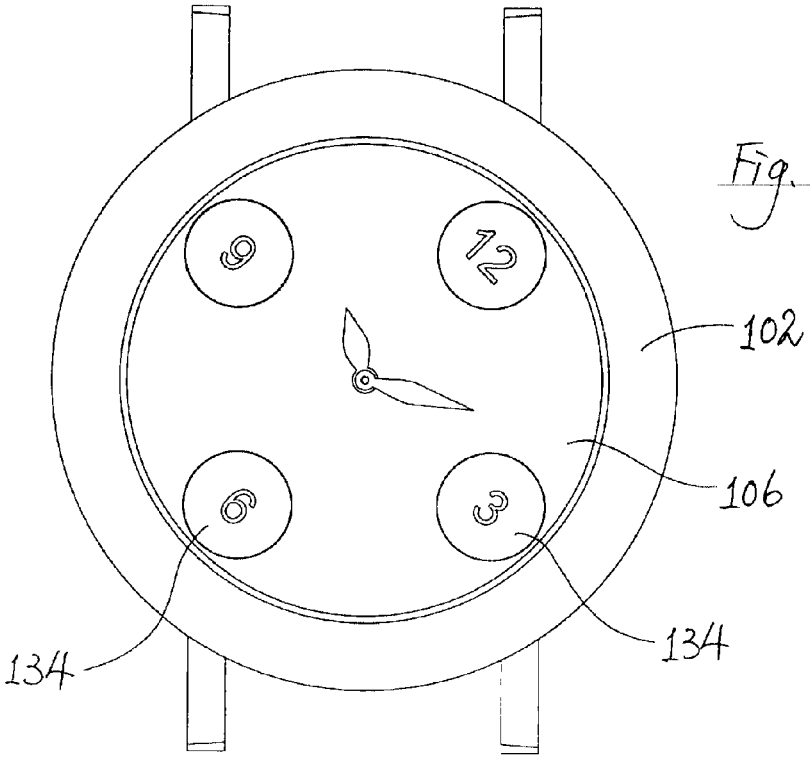
FIG. 9 is a top view of the watch of FIG. 8.
Figure 10:
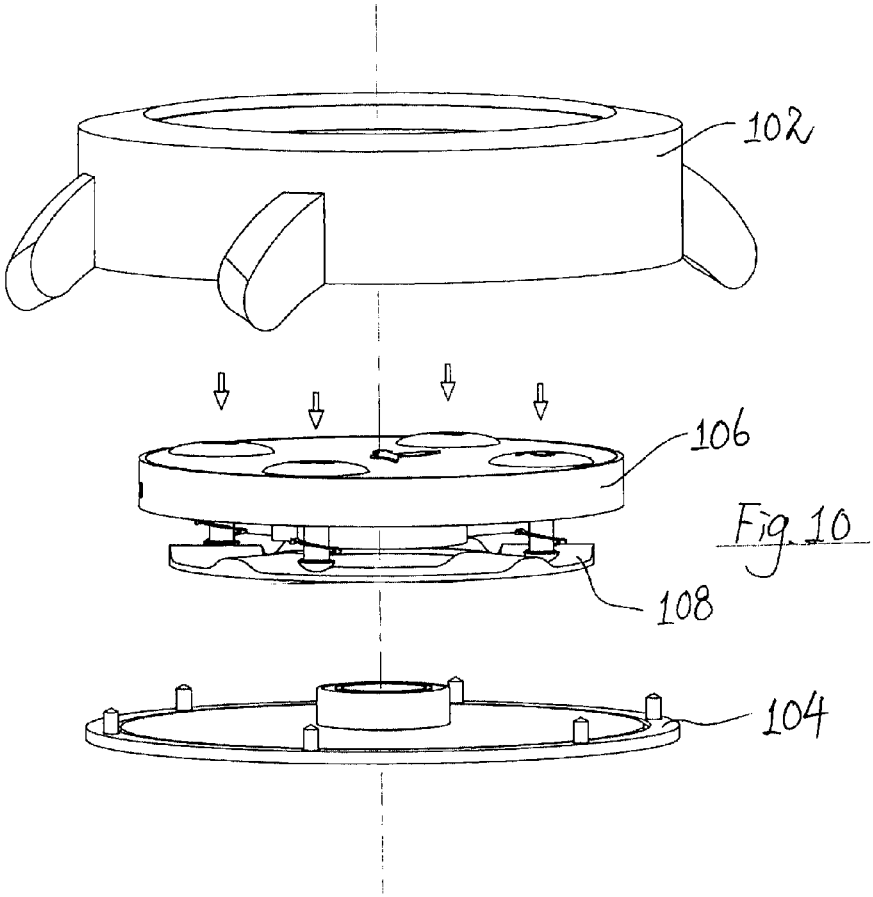
FIG. 10 is an exploded perspective view of the watch of FIG. 4 in which the rotation module is at a fourth position relative to the case.
Figure 11:
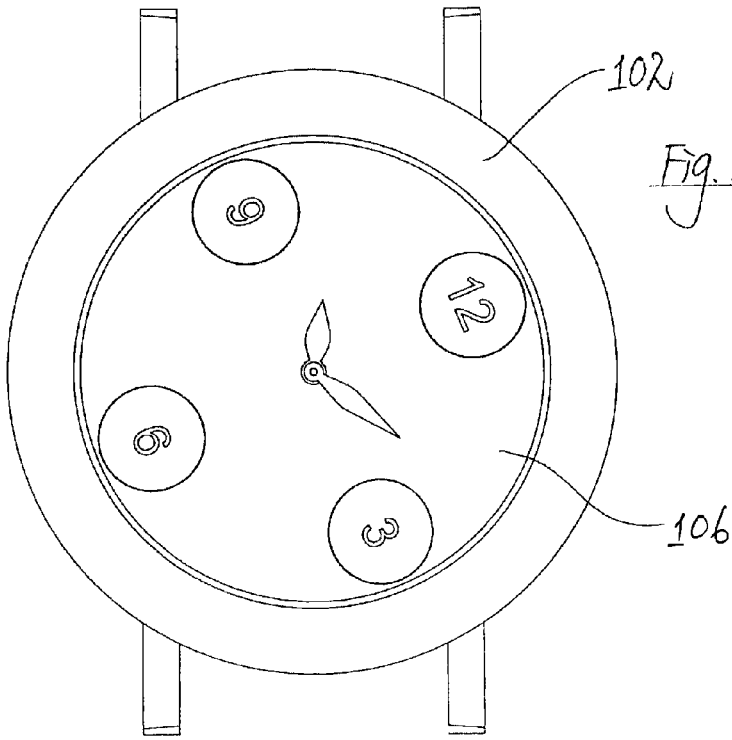
FIG. 11 is a top view of the watch of FIG. 10.
Figure 12:
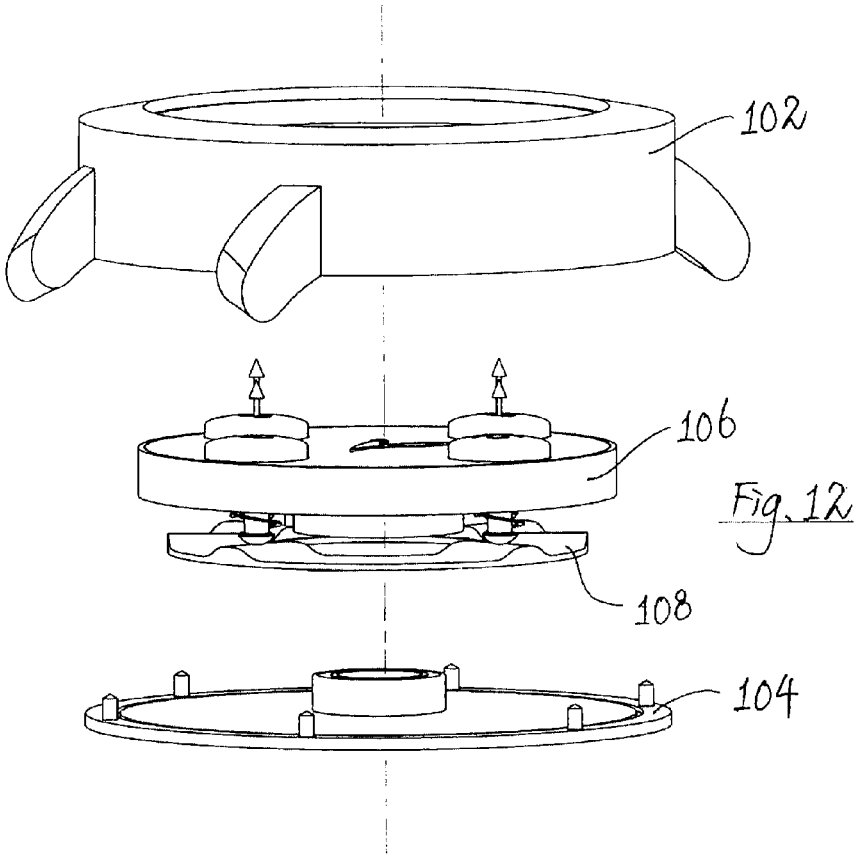
FIG. 12 is an exploded perspective view of the watch of FIG. 4 in which the rotation module is at a fifth position relative to the case.
Figure 13:
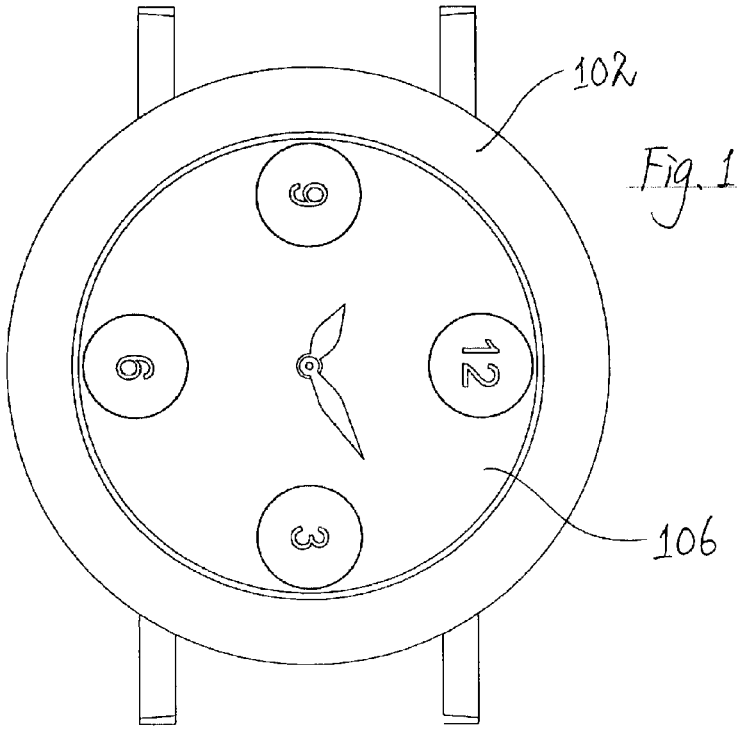
FIG. 13 is a top view of the watch of FIG. 12.
Figure 14:
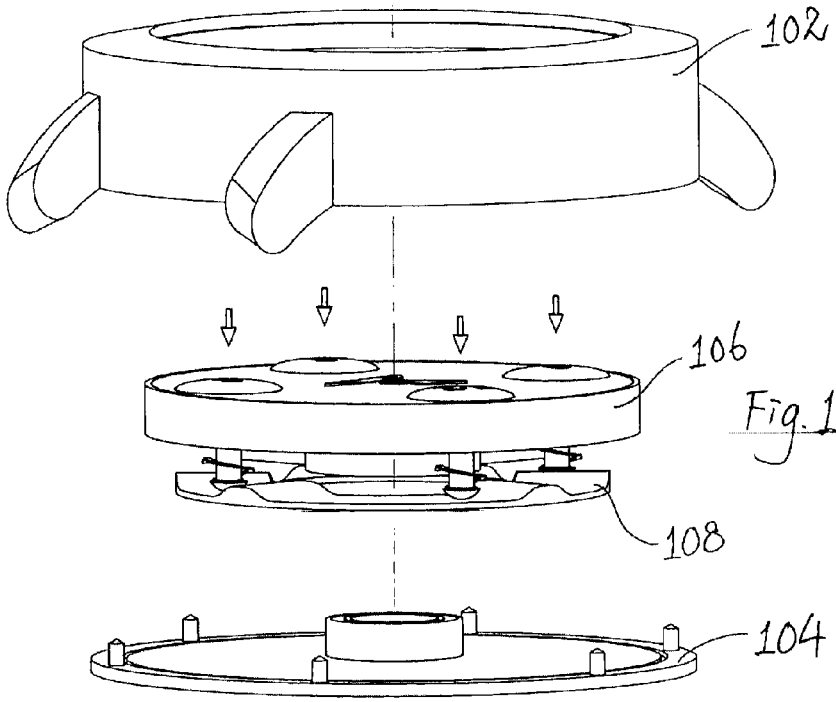
FIG. 14 is an exploded perspective view of the watch of FIG. 4 in which the rotation module is at a sixth position relative to the case.
Figure 15:
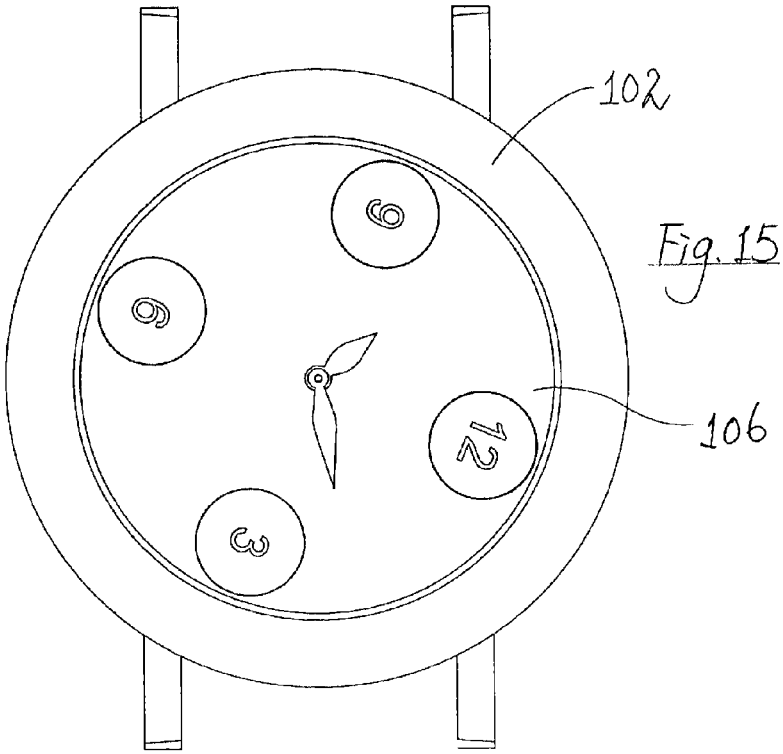
FIG. 15 is a top view of the watch of FIG. 14.
Figure 16:
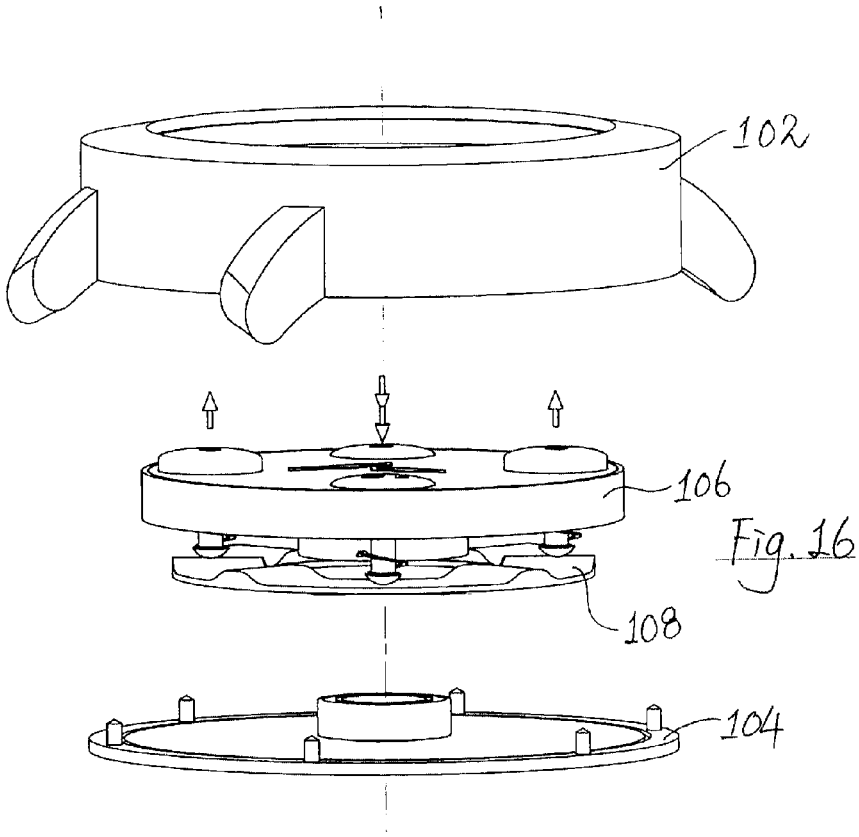
FIG. 16 is an exploded perspective view of the watch of FIG. 4 in which the rotation module is at a seventh position relative to the case.
Figure 17:
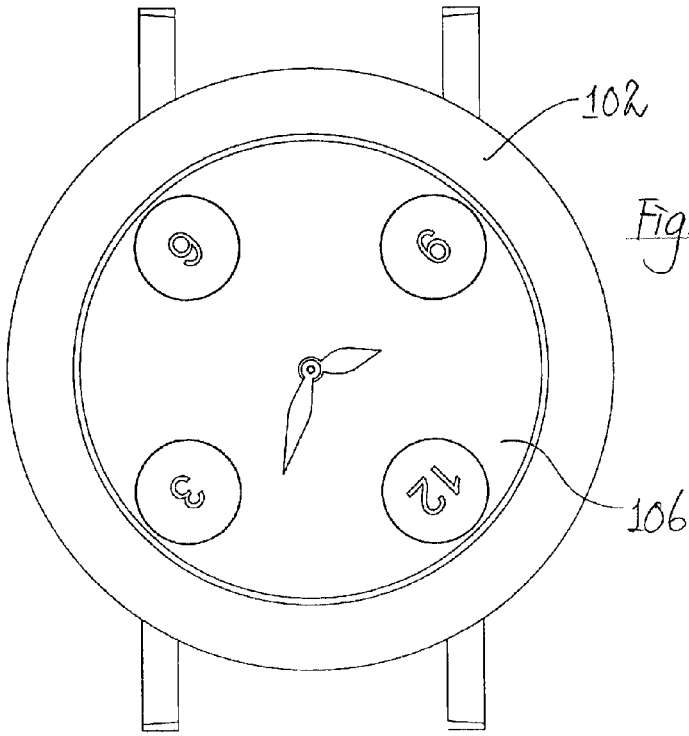
FIG. 17 is a top view of the watch of FIG. 16.

During further rotation of the rotation module 106 relative to the watch case formed by the case body 102 and the case back 104 from the position shown in FIG. 7 to the position shown in FIG. 9, some of the movement parts 134 remain at a respective trough portion 152 of the cam 108 and some of the movement parts 134 rise to a respective crest portion 150. During further rotation of the rotation module 106 relative to the watch case consecutively to the positions shown in FIG. 9, FIG. 11, FIG. 13, FIG. 15 and subsequently FIG. 17, sometimes the movement parts 134 move in a same direction (whether away from the cam 108 or towards the cam 108) along their respective central longitudinal axis $L_{m1}$-$L_{m1}$, $L_{m2}$-$L_{m2}$, $L_{m3}$-$L_{m3}$, $L_{m4}$-$L_{m4}$, and sometimes one or more of the movement parts 134 move along their respective central longitudinal axis $L_{m1}$-$L_{m1}$, $L_{m2}$-$L_{m2}$, $L_{m3}$-$L_{m3}$, $L_{m4}$-$L_{m4}$ in a direction which is different, in particular opposite, to the direction in which one or more of the other movement parts 134 move.

Thus, if the longitudinal axis L-L of the rotation module 106 is not vertical (i.e. if the watch face 128 of the watch dial 118 is not horizontal), the rotation module 106 will rotate relative to the watch case such that the movement part 134 bearing the numeral "6" will be at the position closest to the ground, thus presenting the watch dial 118 for easy reading of time. In other instances where the wearable article is not a watch, the arrangement may be such that if the longitudinal axis L-L of the rotation module 106 is not vertical, the rotation module 106 will rotate relative to the an outer case such that an image, pattern, picture or figure on an upper surface of the rotation module 106 is in an orientation facilitating viewing by a viewer.

It should be noted that:

a. neither the rotational movement of the rotation module 106 relative to the watch case nor the to-and-fro movement of the movement parts 134 relative to the rotational module 106 is electrically powered;

b. the rotational movement of the rotation module 106 relative to the watch case, the rotational movement of the movement parts 134 relative to the watch case about the longitudinal axis L-L of the rotation module, and the to-and-fro movement of the movement parts 134 along their respective central longitudinal axis $L_{m1}$-$L_{m1}$, $L_{m2}$-$L_{m2}$, $L_{m3}$-$L_{m3}$, $L_{m4}$-$L_{m4}$ are all controlled; and c. such movements also enhance the fun and interest in wearing the watch 100.

Figure 18:
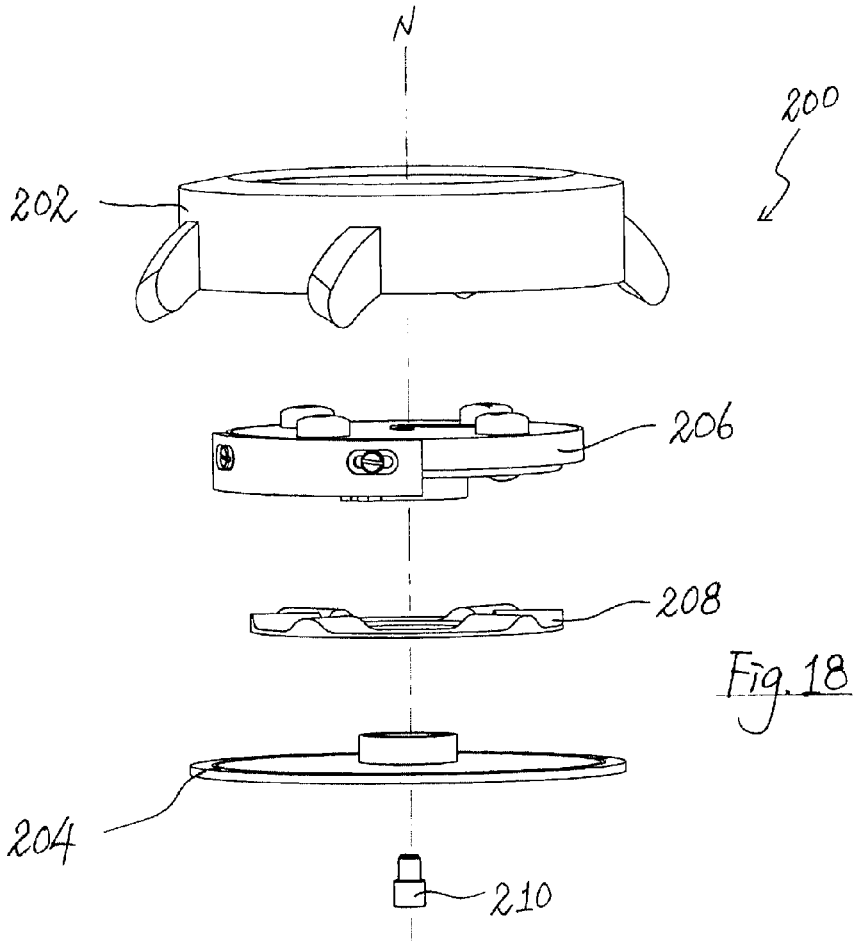
FIG. 18 is an exploded perspective view of a watch according to a second embodiment of the present invention.
Figure 19:
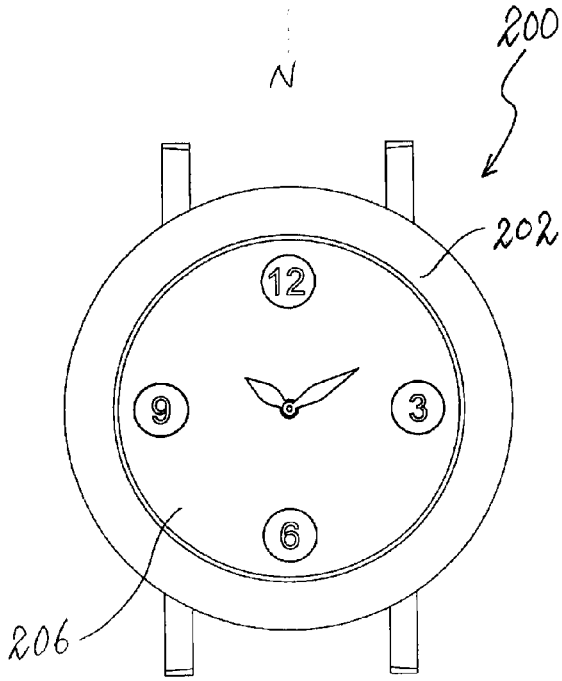
FIG. 19 is a top view of the watch of FIG. 18.

FIG. 18 shows various components of a watch according to a second embodiment of the present invention, generally designated as 200, and FIG. 19 shows a top view of the watch 200. Similar to the watch 100 discussed above, the watch 200 includes a case body 202 and a case back 204 which are engageable with each other to form a watch case with a cylindrical interior cavity. A generally cylindrical rotation module 206 and an annular cam 208 are contained within the cylindrical interior cavity of the watch case formed by the case body 202 and case back 204. The cam 208 is fixedly attached to the case back 204 and thus to the watch case. A time adjustment pusher 210 is also provided, which is operable to allow setting and adjustment of the watch movement (to be discussed below) in the rotation module 206. A bearing 244 (see FIG. 20) is also provided between the rotation module 206 and the base back 204 to allow and facilitate free rotation of the rotation module 206 about its central longitudinal axis N-N relative to the case body 202 and the case back 204 in both clockwise and anti-clockwise directions for at least up to 360°.

The structure and function of the case body 202, case back 204, cam 208, adjustment pusher 210 and bearing 244 of the watch 200 are the same as those of the case body 102, case back 104, cam 108, adjustment pusher 110 and bearing 144 of the watch 100, and will therefore not be repeated here.

Figure 20:
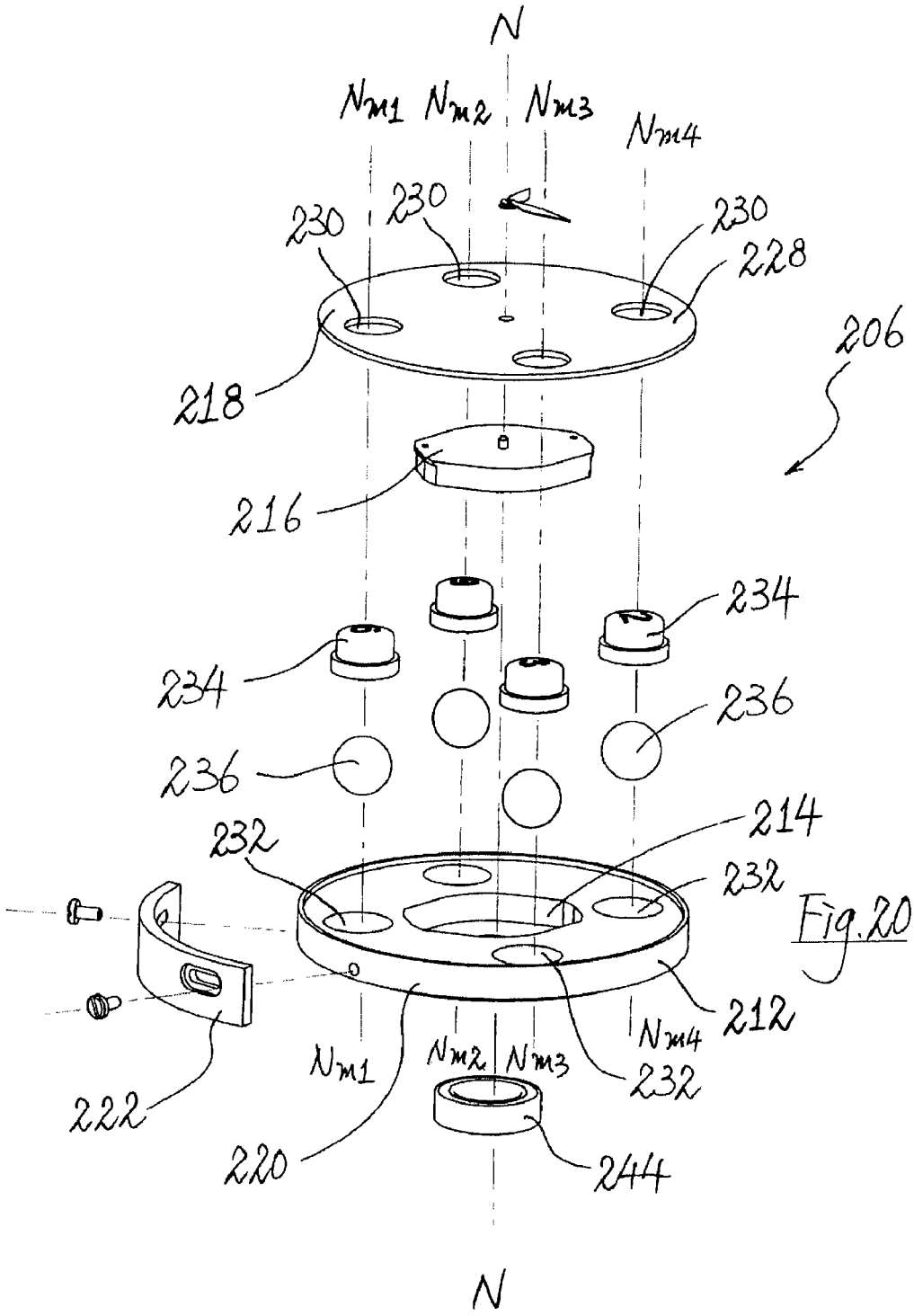
FIG. 20 is an exploded perspective view of a rotation module in the watch of FIG. 18.

Turning to FIG. 20, such shows various components of the rotation module 206. The rotation module 206 includes a base 212 with a cavity 214 within which a watch movement 216 is placed. A watch dial 218 with an upper watch face 228 is engaged with and on the base 212 to contain the watch movement 216. The watch movement 216 is thus movable simultaneously with the watch dial 218 and the base 212.

To an outer periphery 220 of the base 212 is mounted an arc-shaped weight 222. The weight 222 causes the centre of gravity of the rotation module 206 to be away (i.e. offset) from the central longitudinal axis N-N of the rotation module 206. The weight 222 is mounted to the outer periphery 220 of the base 212 such that it is symmetrical about the six o'clock position. By way of this arrangement, the centre of gravity of the rotation module 206 is on a plane which contains both (a) the central longitudinal axis N-N of the rotation module 206 and (b) a line joining a point on the central longitudinal axis N-N of the rotation module 206 and the six o'clock position of the watch dial 218.

The watch dial 218 has four generally circular through-holes 230 which, when the watch dial 218 is assembled with the base 212, are aligned with four circular through-holes 232 in the base 212. The rotation module 206 also carries four generally cylindrical movement parts 234. Each of the four movement parts 234 is marked with a respective numeral, such that the movement parts 234 can act as numeral pads for indication of time.

Figure 21:
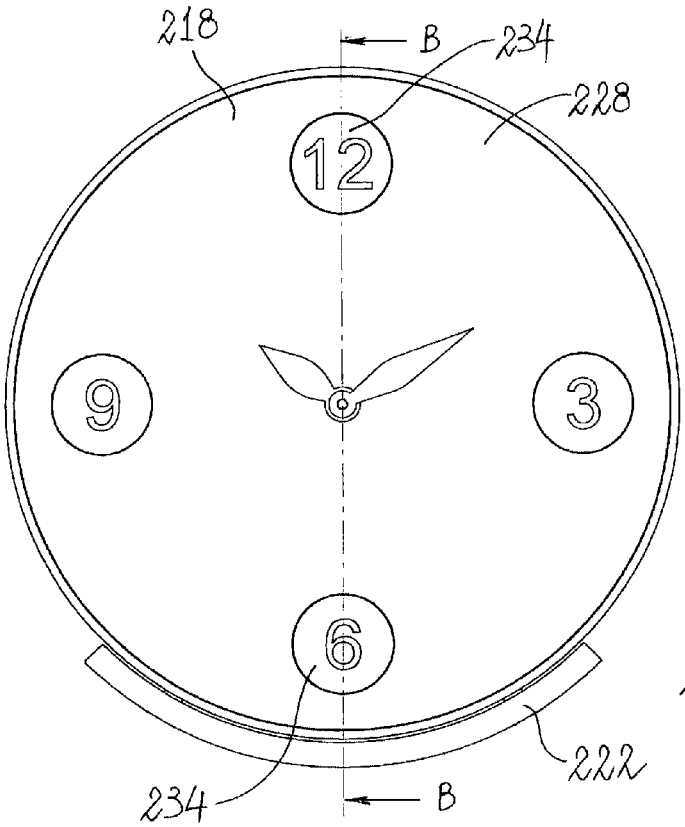
FIG. 21 is a top view of the rotation module of FIG. 20.
Figure 22:
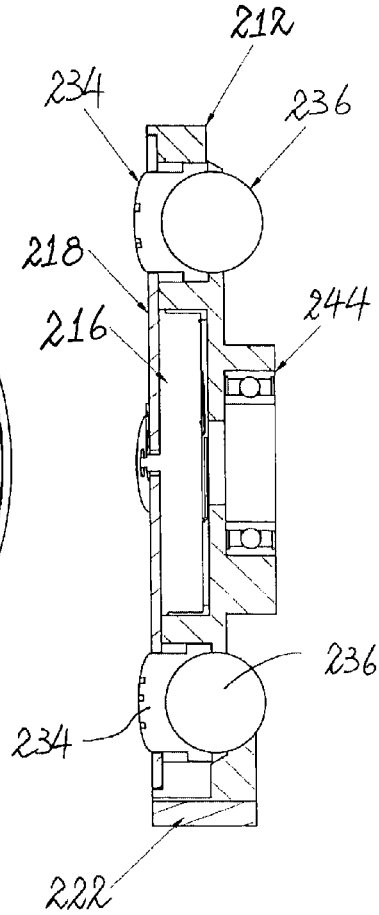
FIG. 22 is a sectional view taken along the line B-B in FIG. 21.
Figure 23:
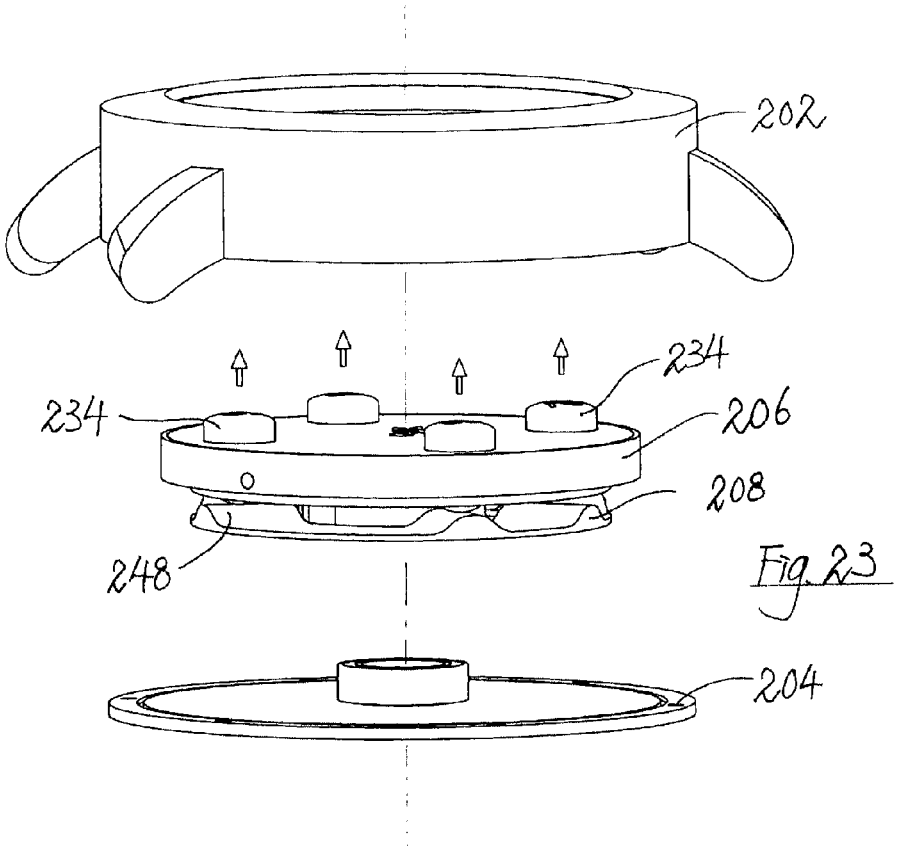
FIG. 23 is an exploded perspective view of the watch of FIG. 18 in which the rotation module is at a first position relative to a case of the watch.

It can be further seen in FIGS. 21 and 22 that the rotation module 206 also carries four spherical parts 236, each in contact and co-operation with a respective movement part 234.

The holes 230, 232 are sized and configured to be slightly larger than the movement part 234 so as to allow the movement part 234 to move relative to the base 212 (and thus the rotation module 206). In particular, each of the movement parts 234 is movable relative to the base 212 and to-and-fro along its respective longitudinal axis $N_{m1}$-$N_{m1}$, $N_{m2}$-$N_{m2}$, $N_{m3}$-$N_{m3}$, $N_{m4}$-$N_{m4}$ which is parallel to the central longitudinal axis N-N of the rotation module 206.

A main difference between the rotation module 206 of the watch 200 and the rotation module 106 of the watch 100 is that, in the rotation module 206, the movement parts 234 are not in direct engagement and contact with an undulating cam surface 248 of the cam 208. Instead, each of the movement parts 234 is in indirect engagement with the cam surface 248 of the cam 208 via a respective intermediate spherical part 236.

Figure 24:
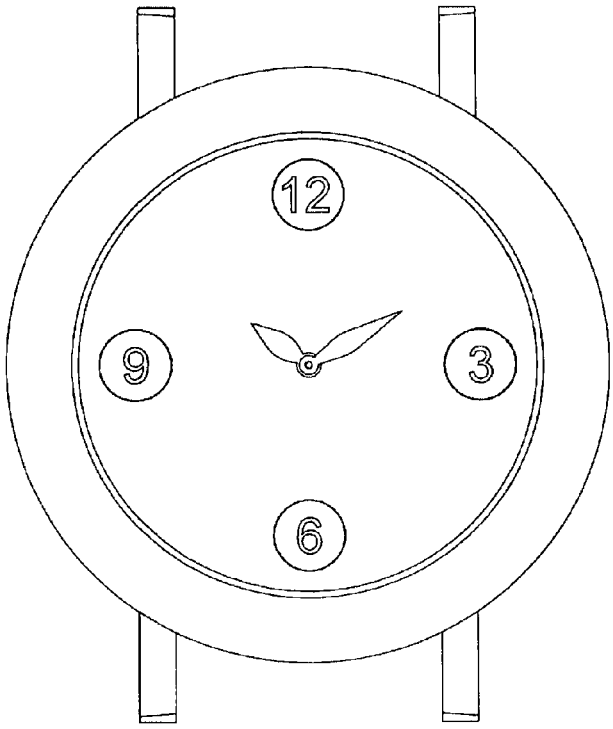
FIG. 24 is a top view of the watch of FIG. 23.
Figure 25:
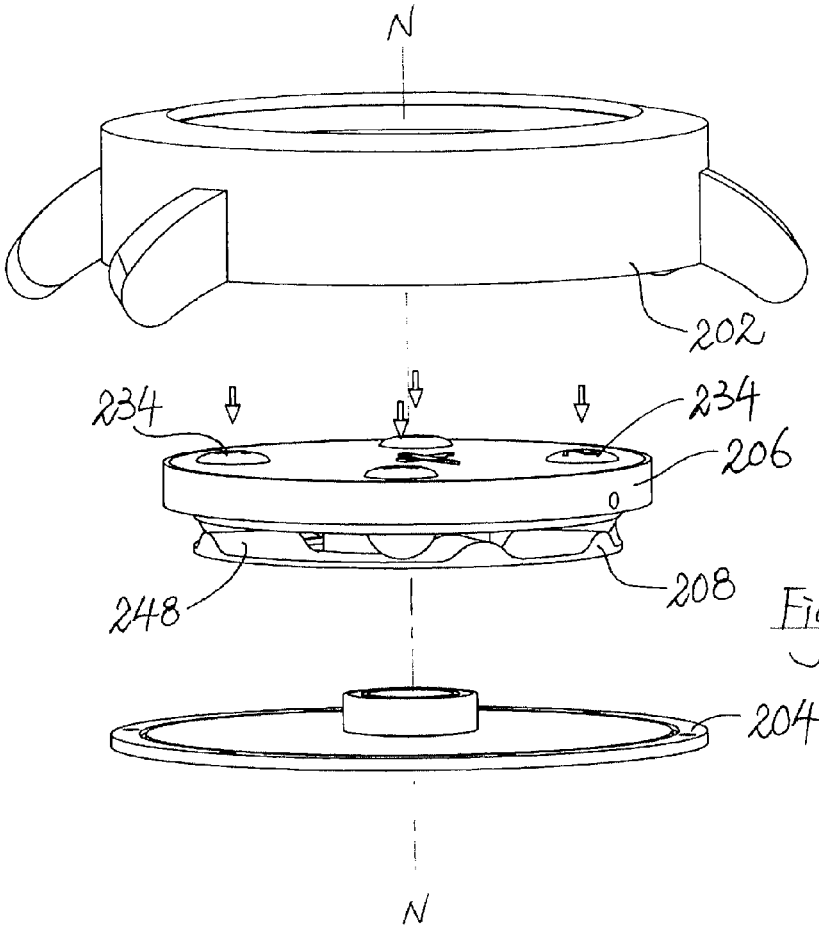
FIG. 25 is an exploded perspective view of the watch of FIG. 18 in which the rotation module is at a second position relative to the case.
Figure 26:
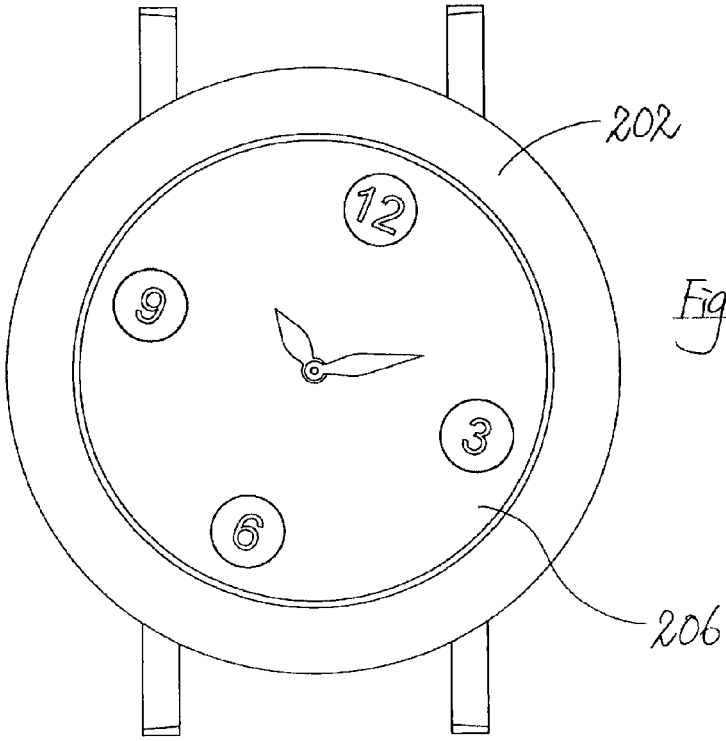
FIG. 26 is a top view of the watch of FIG. 25.
Figure 27:
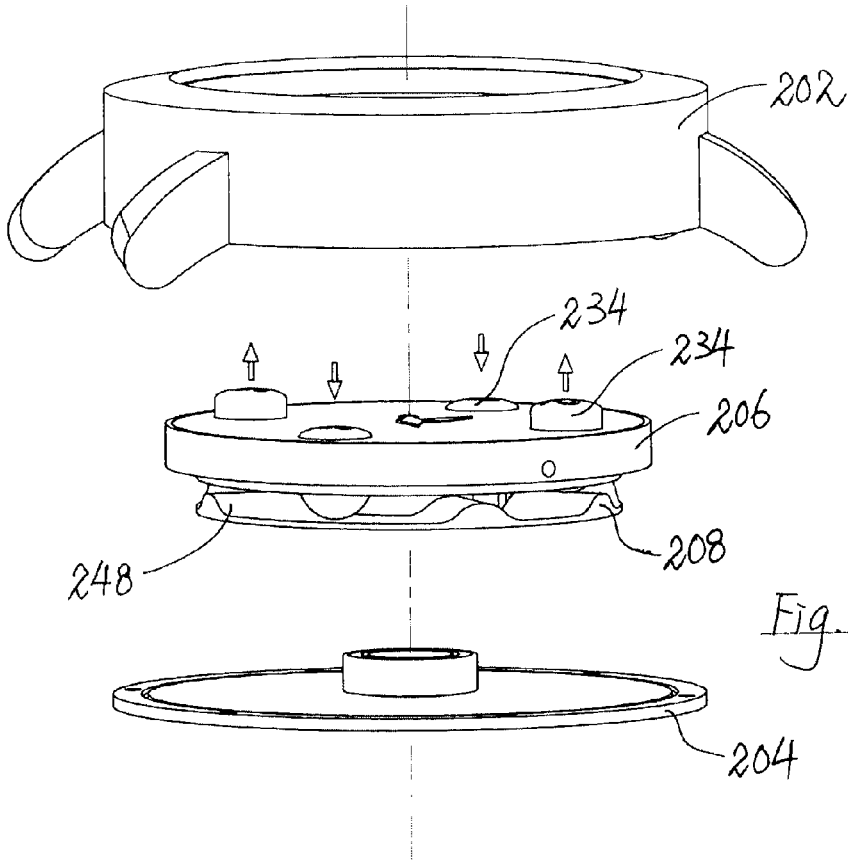
FIG. 27 is an exploded perspective view of the watch of FIG. 18 in which the rotation module is at a third position relative to the case.
Figure 28:
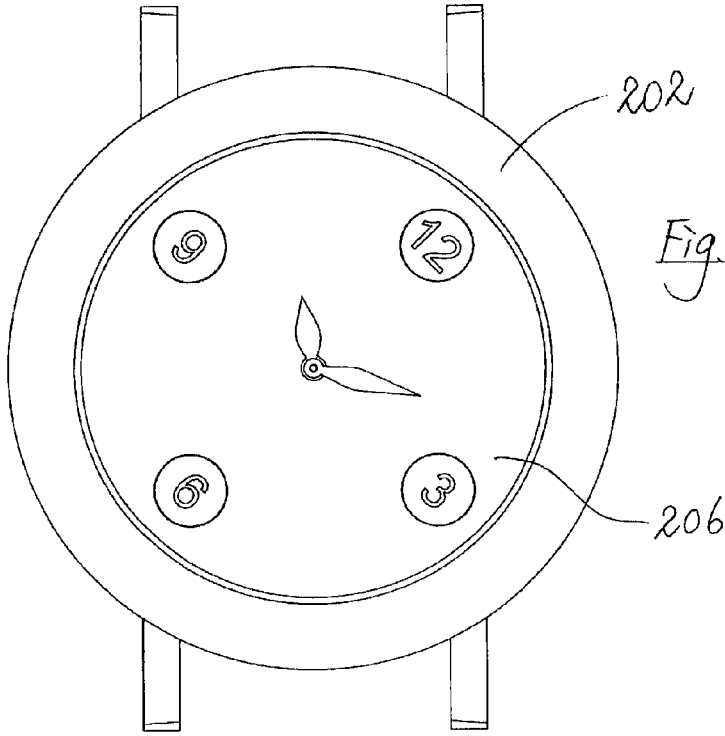
FIG. 28 is a top view of the watch of FIG. 27.
Figure 29:
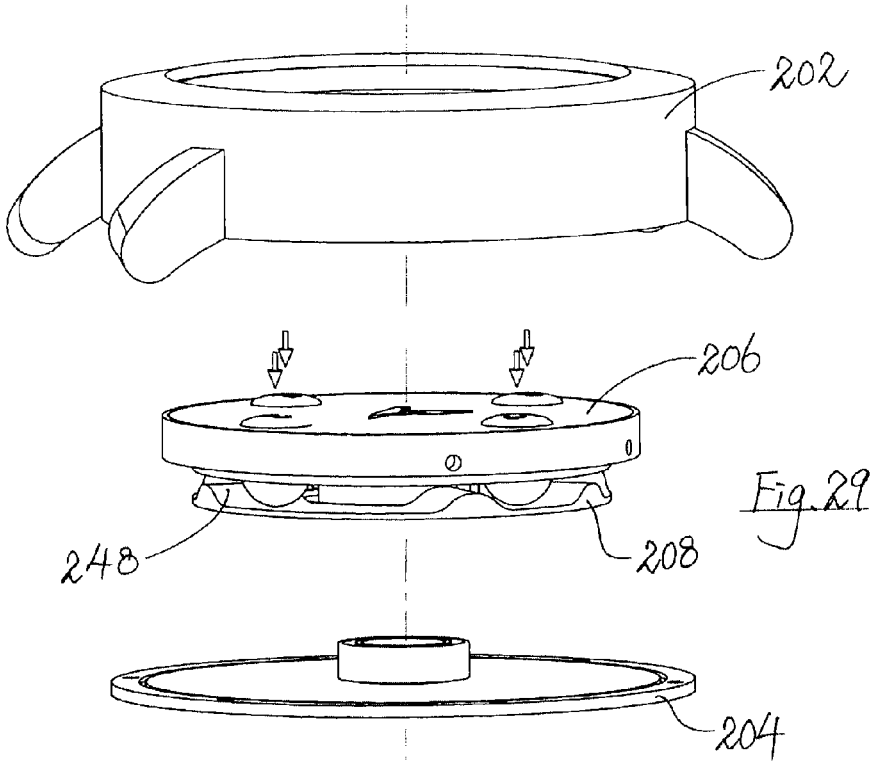
FIG. 29 is an exploded perspective view of the watch of FIG. 18 in which the rotation module is at a fourth position relative to the case.
Figure 30:
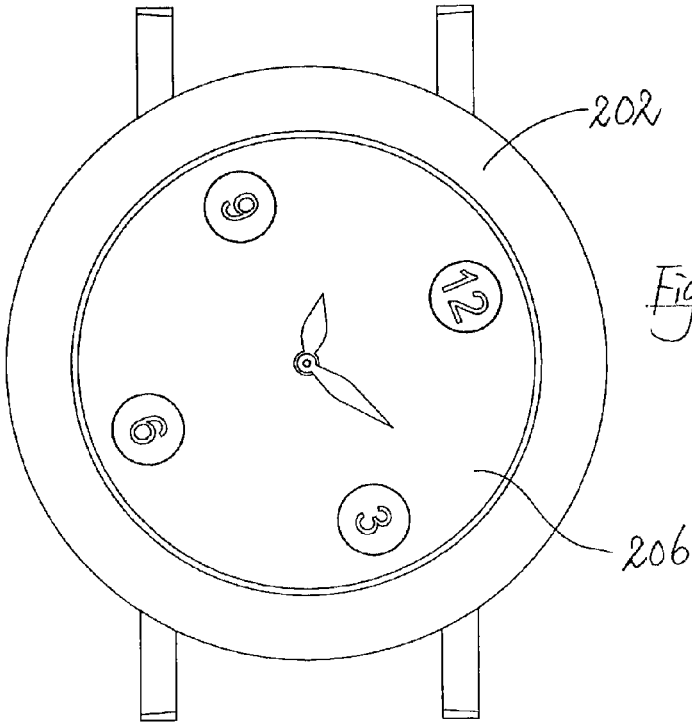
FIG. 30 is a top view of the watch of FIG. 29.
Figure 31:
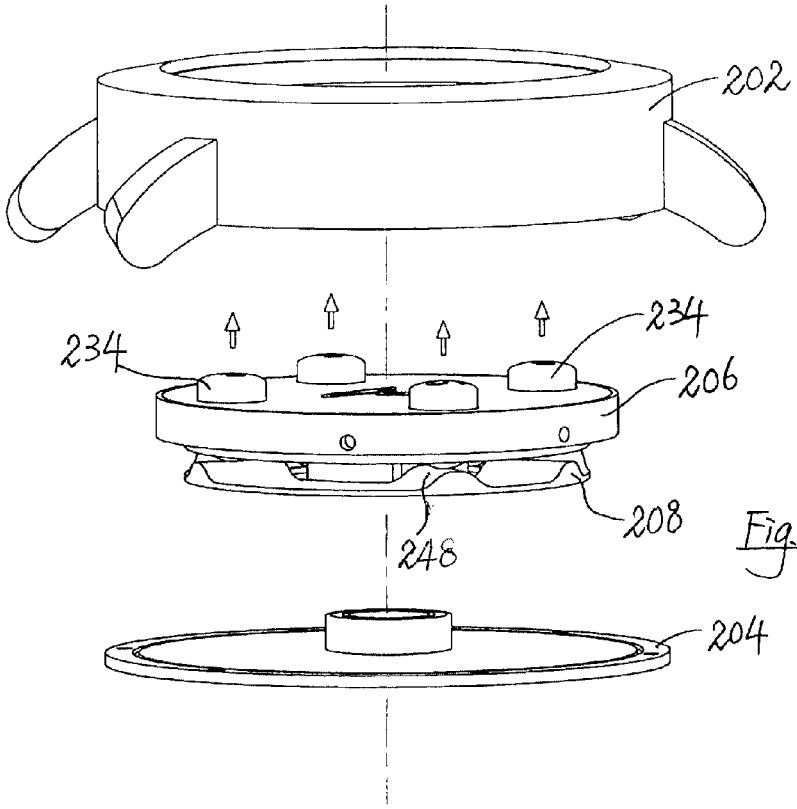
FIG. 31 is an exploded perspective view of the watch of FIG. 18 in which the rotation module is at a fifth position relative to the case.
Figure 32:
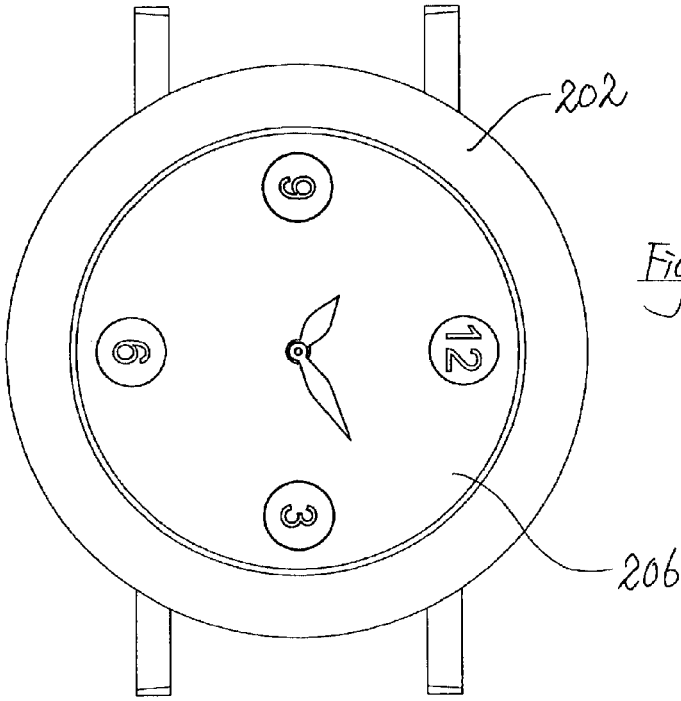
FIG. 32 is a top view of the watch of FIG. 31.
Figure 33:
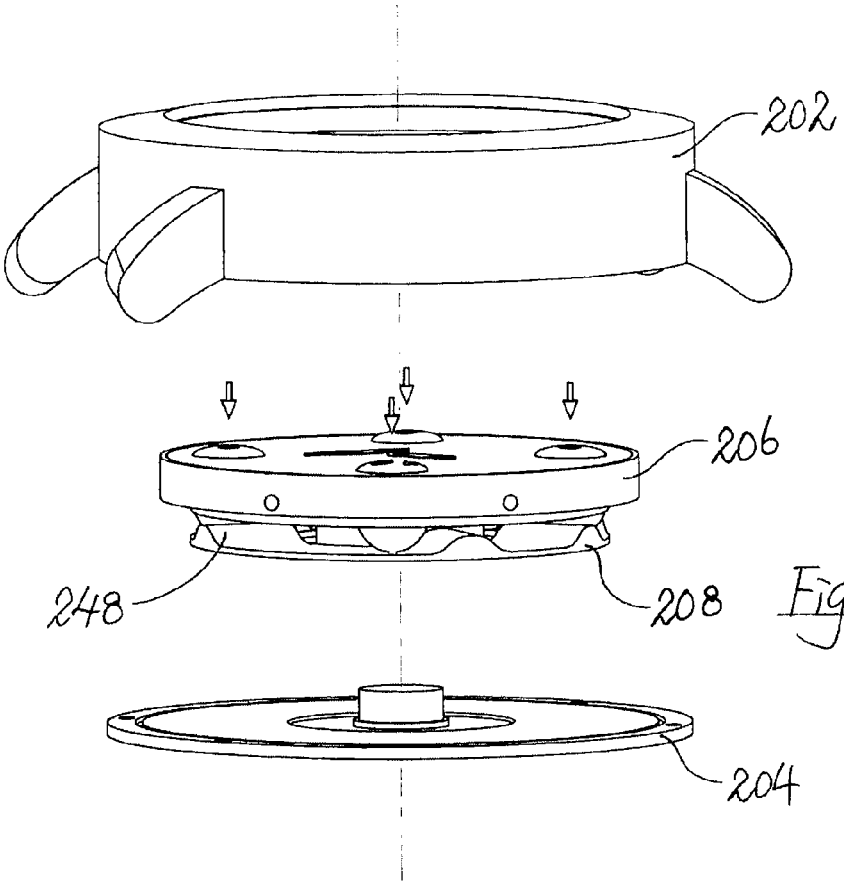
FIG. 33 is an exploded perspective view of the watch of FIG. 18 in which the rotation module is at a sixth position relative to the case.
Figure 34:
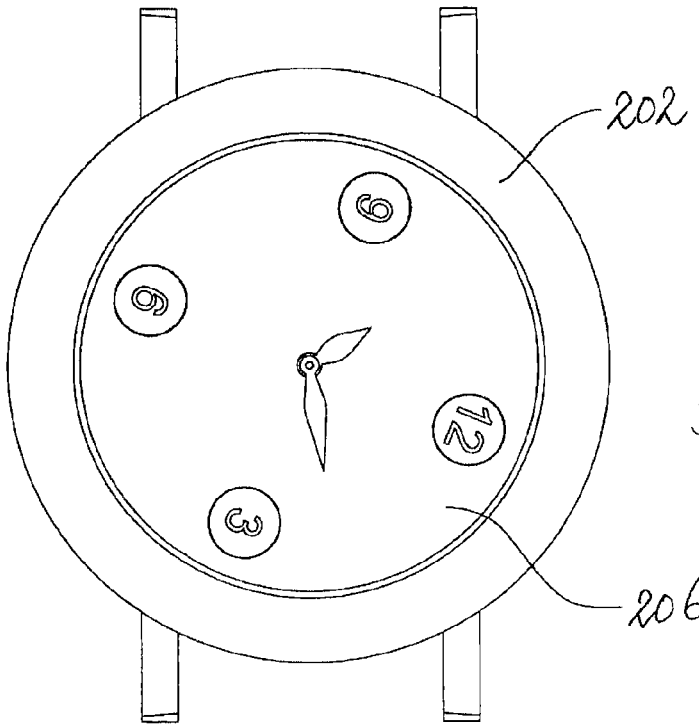
FIG. 34 is a top view of the watch of FIG. 33.
Figure 35:
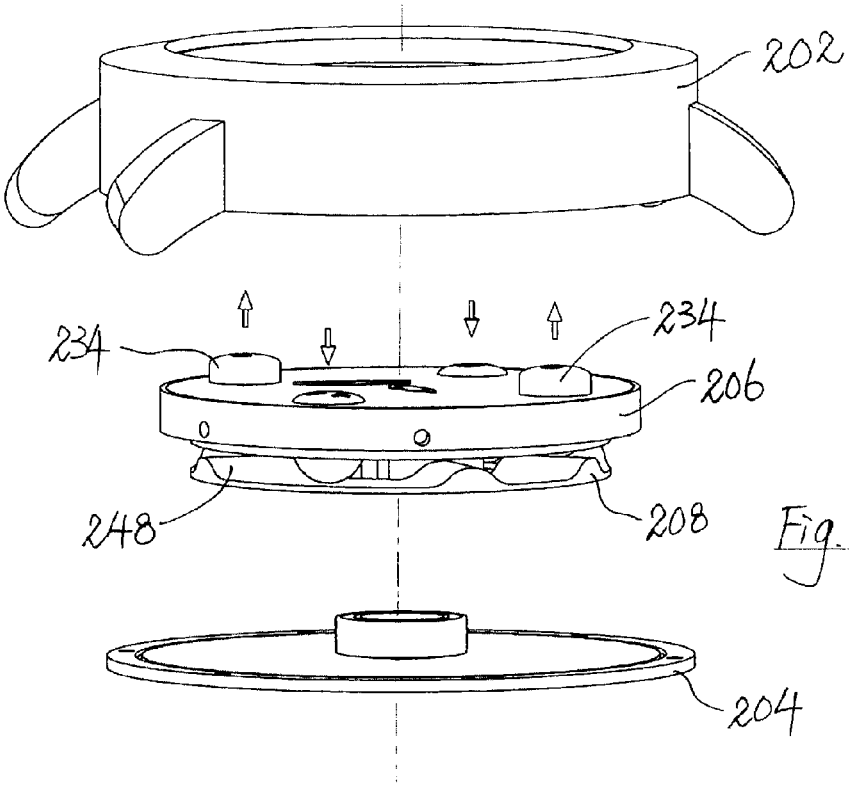
FIG. 35 is an exploded perspective view of the watch of FIG. 18 in which the rotation module is at a seventh position relative to the case.
Figure 36:
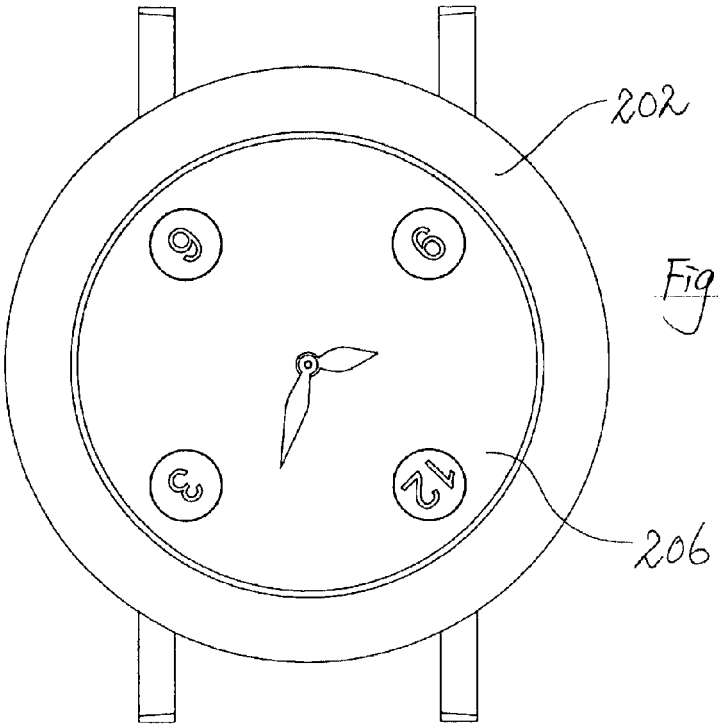
FIG. 36 is a top view of the watch of FIG. 35.

During rotation of the rotation module 206 relative to the watch case formed by the case body 202 and case back 204, the spherical parts 236 contact and travel on the undulating cam surface 248 of the cam 208. The spherical parts 236 will thus move to-and-fro along the respective longitudinal axis $N_{m1}$-$N_{m1}$, $N_{m2}$-$N_{m2}$, $N_{m3}$-$N_{m3}$, $N_{m4}$-$N_{m4}$ of the movement part 234 with which they are in contact, to thereby cause the movement parts 234 to each move to-and-fro along their respective longitudinal axis $N_{m1}$-$N_{m1}$, $N_{m2}$-$N_{m2}$, $N_{m3}$-$N_{m3}$, $N_{m4}$-$N_{m4}$. In addition, during rotation of the rotation module 206 relative to the case body 202 from the position shown in FIG. 24, consecutively to the positions shown in FIG. 26, FIG. 28, FIG. 30, FIG. 32, FIG. 34, and subsequent FIG. 36, the spherical parts 236 also self-rotate relative to the rotation module 206. However, as the contact between the spherical parts 236 and their respective co-operative movement parts 234 is smooth, the self-rotational movement of the spherical parts 236 will not cause the movement parts 234 to also self-rotate. The spherical parts 236 therefore also self-rotate relative to the respective movement parts 234.

Figure 37:
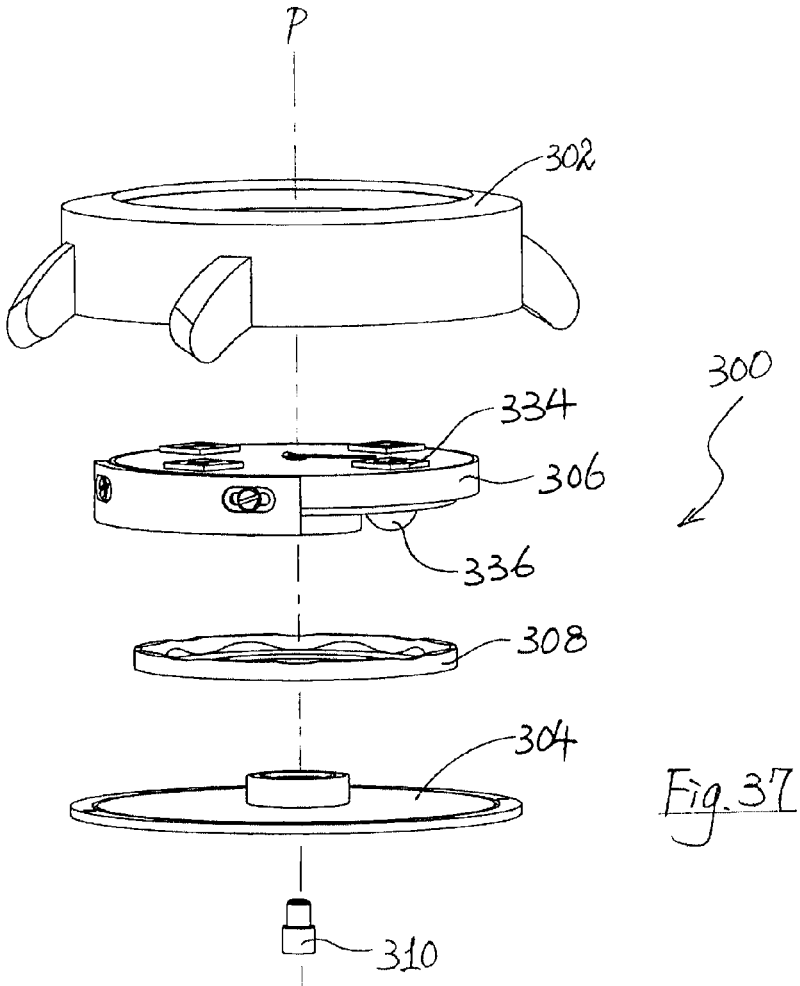
FIG. 37 is an exploded perspective view of a watch according to a third embodiment of the present invention.
Figure 38:
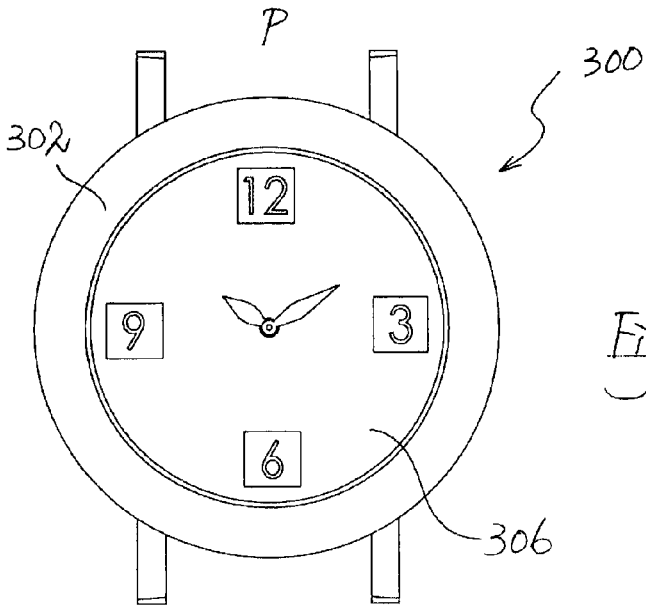
FIG. 38 is a top view of the watch of FIG. 37.
Figure 39:
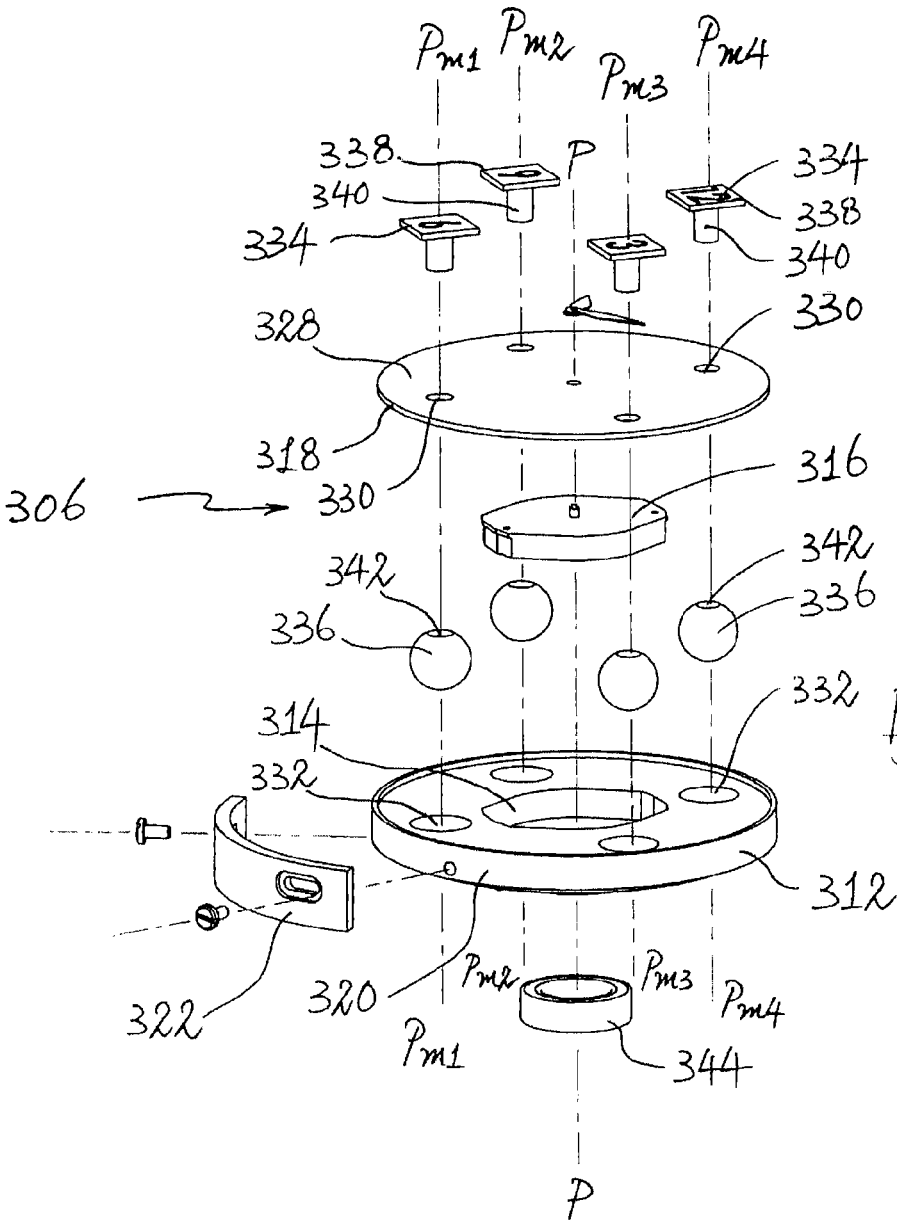
FIG. 39 is an exploded perspective view of a rotation module in the watch of FIG. 37.
Figure 40:
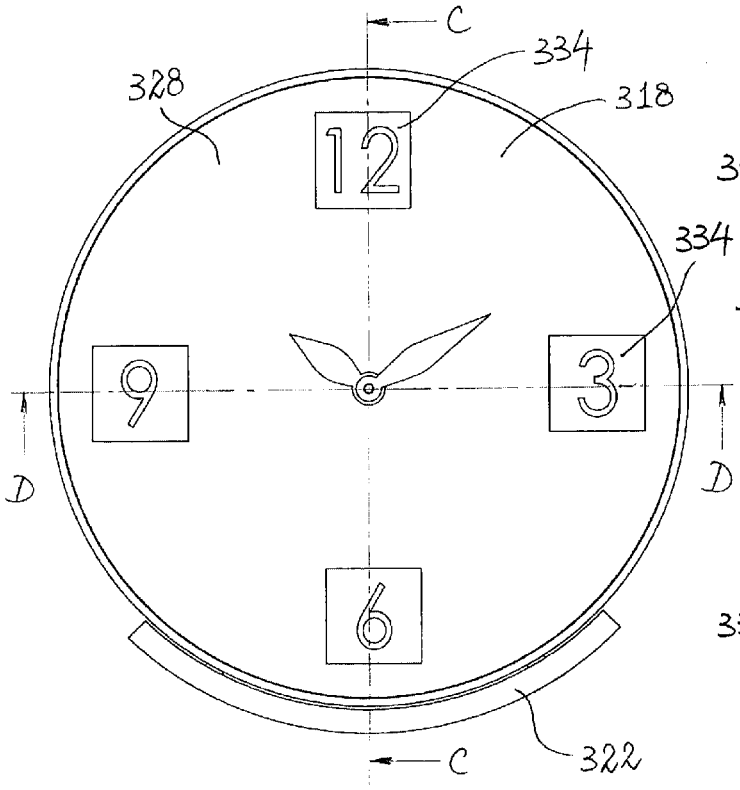
FIG. 40 is a top view of the rotation module of FIG. 39.
Figure 41:
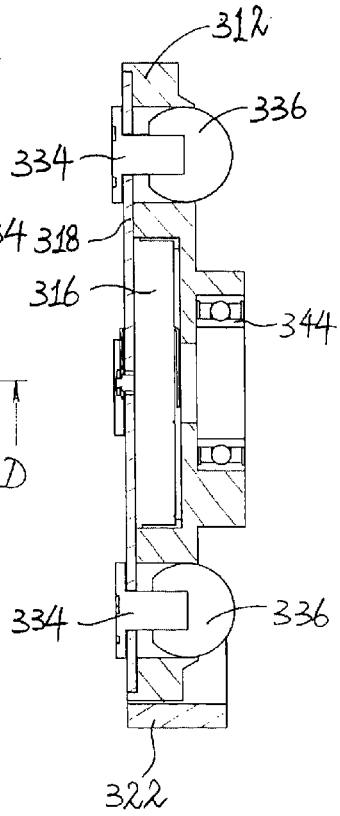
FIG. 41 is a sectional view taken along the line C-C of FIG. 40.
Figure 42:
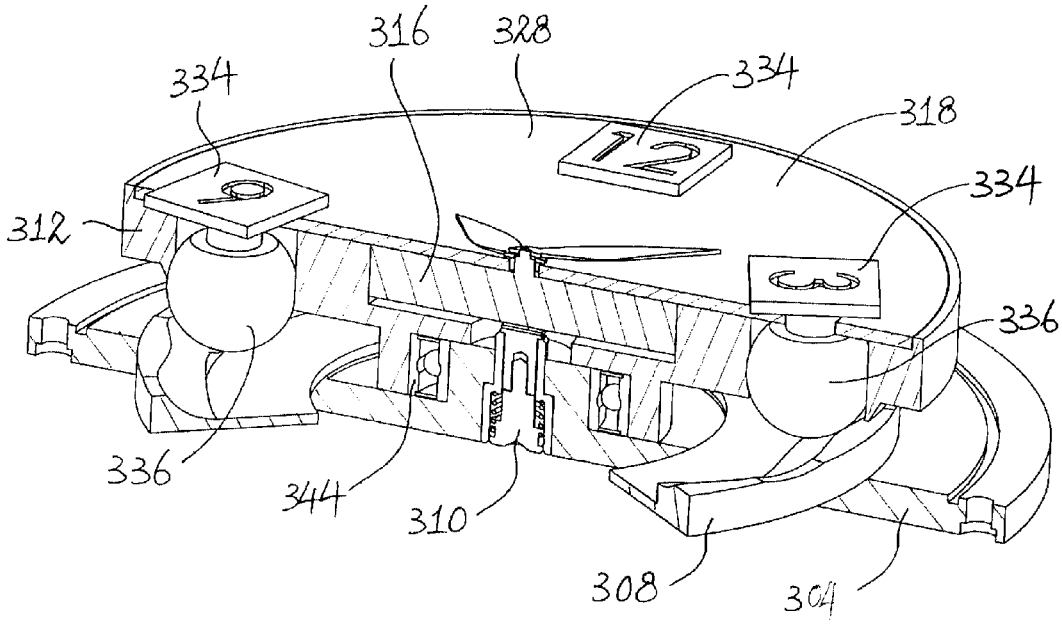
FIG. 42 is a sectional perspective view taken along the line D-D of FIG. 40, with the rotation module resting on a case back.
Figure 43:
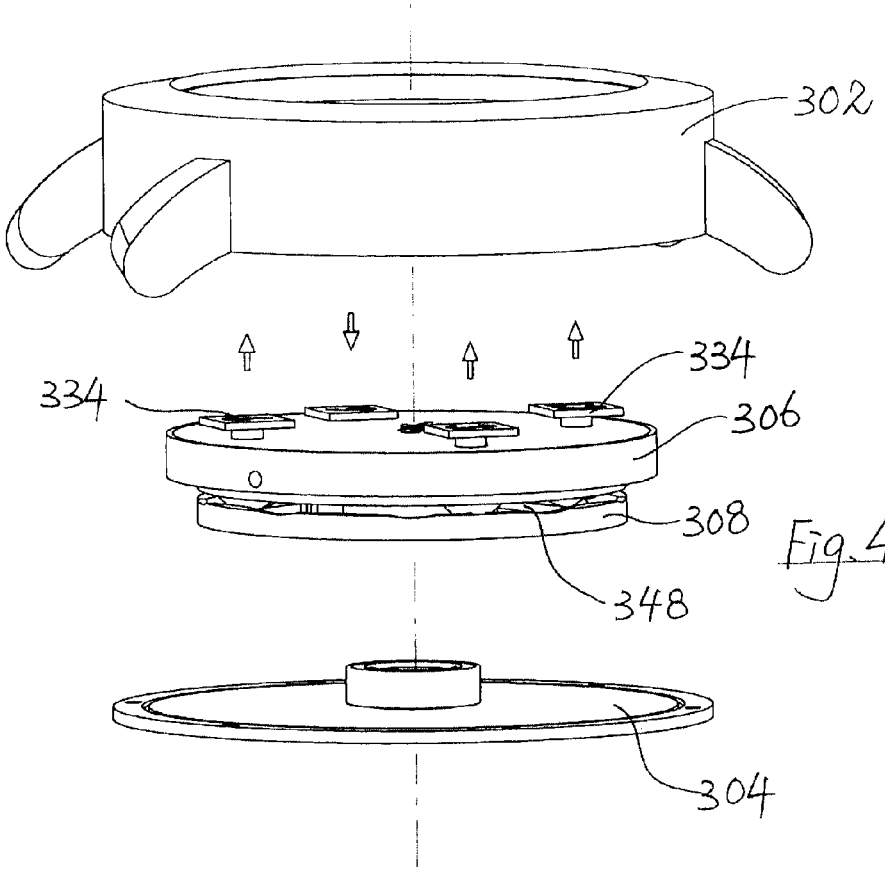
FIG. 43 is an exploded perspective view of the watch of FIG. 37 in which the rotation module is at a first position relative to a case of the watch.

FIG. 37 shows various components of a watch according to a third embodiment of the present invention, generally designated as 300, and FIG. 38 shows a top view of the watch 300. Similar to the watches 100, 200 discussed above, the watch 300 includes a case body 302 and a case back 304 which are engageable with each other to form a watch case with a cylindrical interior cavity. A generally cylindrical rotation module 306 and an annular cam 308 are contained within the cylindrical interior cavity of the watch case formed by the case body 302 and case back 304. The cam 308 is fixedly attached to the case back 304 and thus to the watch case. A time adjustment pusher 310 is also provided, which is operable to allow setting and adjustment of the watch movement (to be discussed below) in the rotation module 306. A bearing 344 (see FIG. 39) is also provided between the rotation module 306 and the base back 304 to allow and facilitate free rotation of the rotation module 306 about its central longitudinal axis P-P relative to the watch case in both clockwise and anti-clockwise directions for at least up to 360°.

The structure and function of the case body 302, case back 304, cam 308, adjustment pusher 310 and bearing 344 of the watch 300 are the same as those of the case body 102, case back 104, cam 108, adjustment pusher 110 and bearing 144 of the watch 100, and will therefore not be repeated here.

FIGS. 39 to 42 show various views of the rotation module 306. The rotation module 306 includes a base 312 with a cavity 314 within which a watch movement 316 is placed. A watch dial 318 with an upper watch face 328 is engaged with and on the base 312 to contain the watch movement 316. The watch movement 316 is thus movable simultaneously with the watch dial 318 and the base 312.

To an outer periphery 320 of the base 312 is mounted an arc-shaped weight 322. The weight 322 causes the centre of gravity of the rotation module 306 to be away (i.e. offset) from the central longitudinal axis P-P of the rotation module 306. The weight 322 is mounted to the outer periphery 320 of the base 312 such that it is symmetrical about the six o'clock position. By way of this arrangement, the centre of gravity of the rotation module 306 is on a plane which contains both (a) the central longitudinal axis P-P of the rotation module 306 and (b) a line joining a point on the central longitudinal axis P-P of the rotation module 306 and the six o'clock position of the watch dial 318.

The watch dial 318 has four generally circular through-holes 330 which, when the watch dial 318 is assembled with the base 312, are aligned with four circular through-holes 332 in the base 312. It can be seen that the diameter of the through-holes 330 is smaller than that of the through-holes 332. The rotation module 306 also carries four movement parts 334. Each of the four movement parts 334 is marked with a respective numeral, such that the movement parts 334 can act as numeral pads for indication of time. Each of the movement parts 334 has a broad head 338 and a narrow pin 340. Each of the through-holes 330 is sized and configured to allow the pin 340 of the movement part 334 to pass through for length-wise to-and-fro movement, but prevent the head 338 from passing through it.

It can be further seen that the rotation module 306 also carries four generally spherical intermediate parts 336, each in engagement and co-operation with a respective movement part 334. Each of the spherical parts 336 has a recess 342 which is sized and configured to receive the pin 340 of a respective movement part 334. The pin 340 and the recess 342 are fixedly engaged with each other, e.g. by force fit or interference fit, so that the movement parts 334 and the respective spherical parts 336 are simultaneously movable with each other.

The holes 332 of the base 312 are sized and configured to be slightly larger than the spherical parts 336 so as to allow the spherical parts 336 to move relative to the base 312 (and thus the rotation module 306). In particular, each of the spherical parts 336 and the respective movement part 334 engaged with it are movable relative to the base 312 to-and-fro along their respective common longitudinal axis $P_{m1}$-$P_{m1}$, $P_{m2}$-$P_{m2}$, $P_{m3}$-$P_{m3}$, $P_{m4}$-$P_{m4}$ which is parallel to the central longitudinal axis P-P of the rotation module 306.

A main difference between the rotation module 306 of the watch 300 and the rotation module 206 of the watch 200 is that, in the rotation module 306 of the watch 300, as each of the spherical parts 336 is fixedly engaged with the respective movement part 334, self-rotation of the spherical parts 336 will bring about corresponding and simultaneous self-rotational movement of the respective movement part 334. Because of the orientation and size of the through-holes 330, the spherical parts 336 can only self-rotate about their respective longitudinal axis $P_{m1}$-$P_{m1}$, $P_{m2}$-$P_{m2}$, $P_{m3}$-$P_{m3}$, $P_{m4}$-$P_{m4}$, thus causing the movement parts 334 to self-rotate in like manner. Of course, if the through-holes 330 are oriented or sized in other manners, the axis about which the respective movement part 334 and spherical part 336 self-rotate may be inclined relative to the central longitudinal axis P-P of the rotation module 306.

Figure 44:
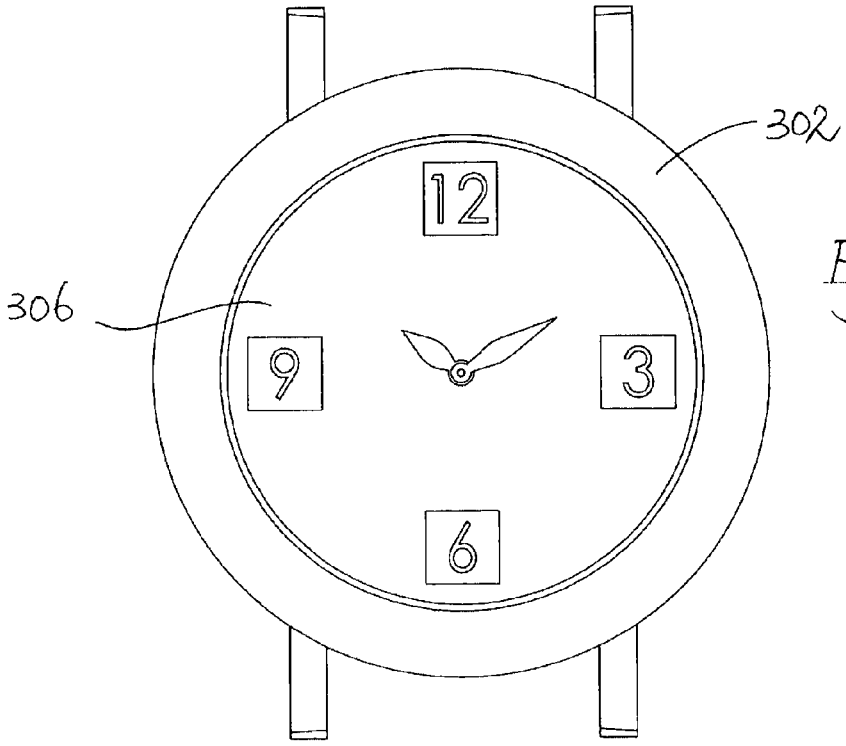
FIG. 44 is a top view of the watch of FIG. 43.
Figure 45:
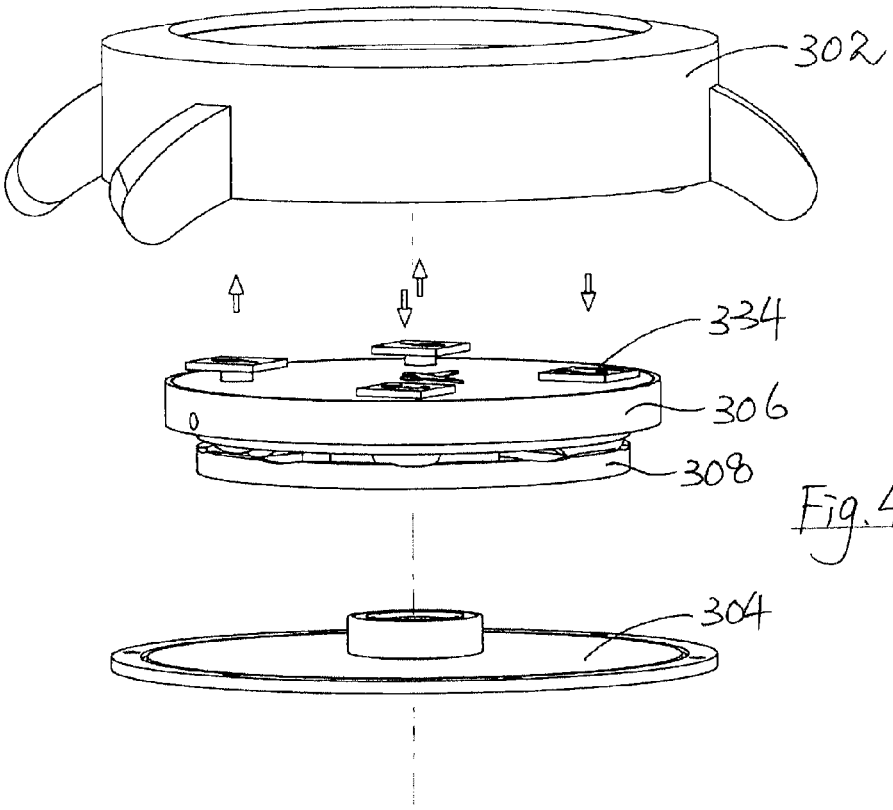
FIG. 45 is an exploded perspective view of the watch of FIG. 37 in which the rotation module is at a second position relative to the case.
Figure 46:
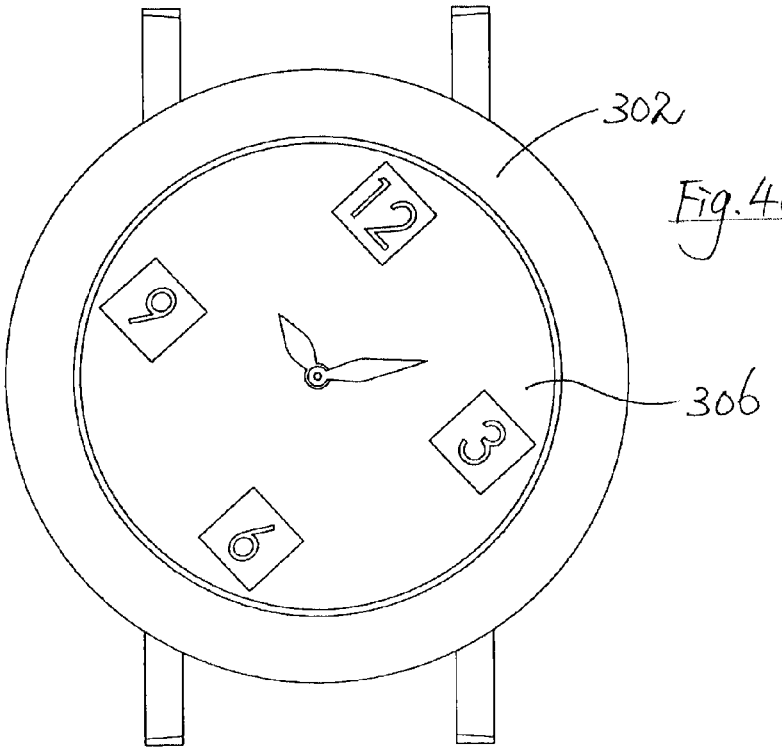
FIG. 46 is a top view of the watch of FIG. 45.
Figure 47:
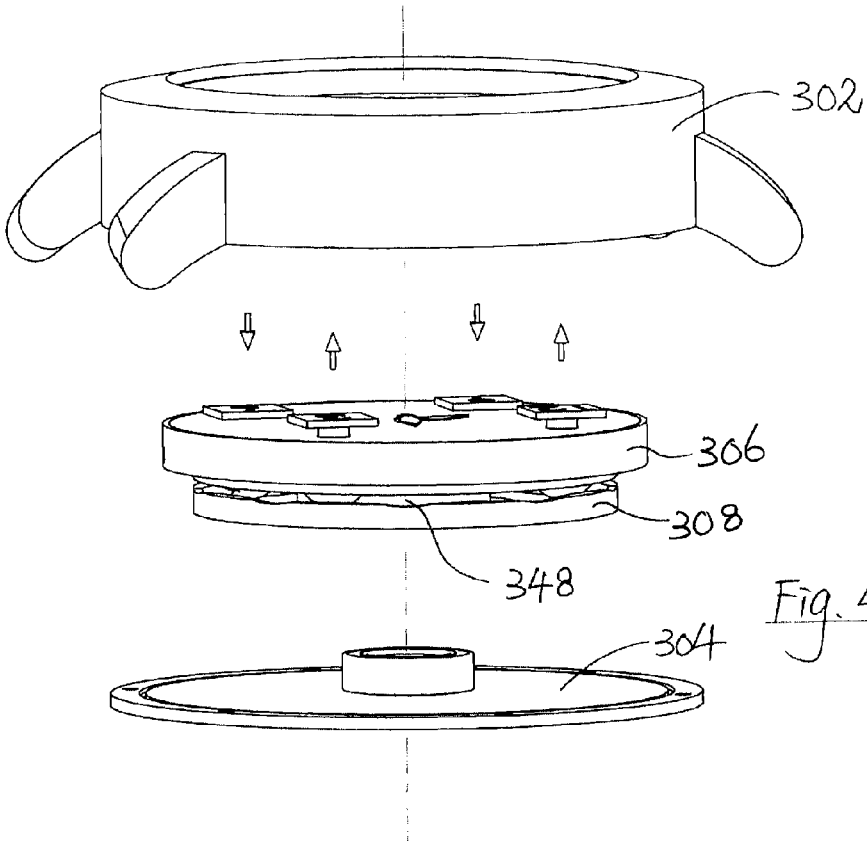
FIG. 47 is an exploded perspective view of the watch of FIG. 37 in which the rotation module is at a third position relative to the case.
Figure 48:
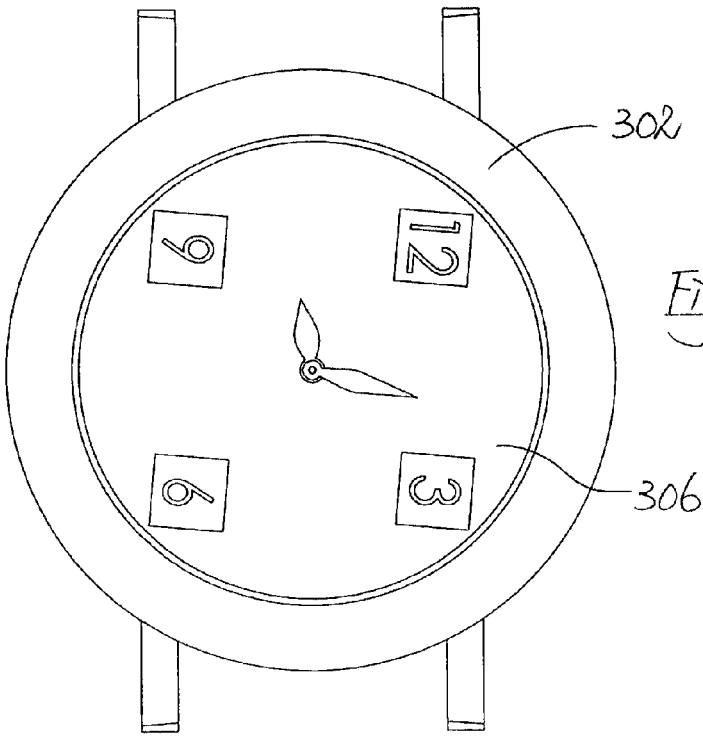
FIG. 48 is a top view of the watch of FIG. 47.
Figure 49:
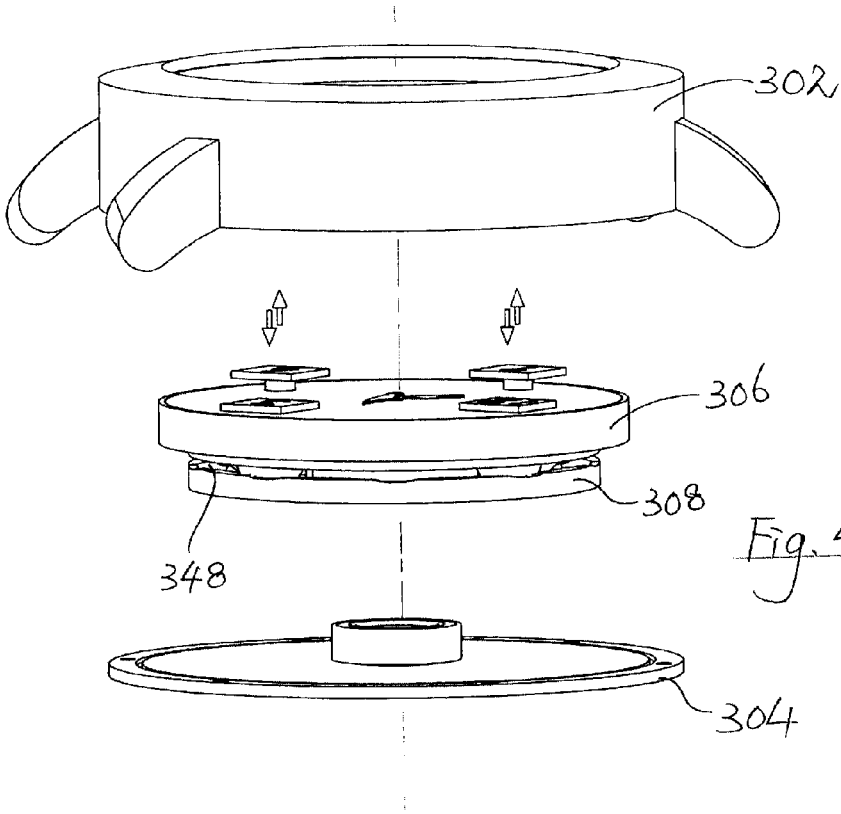
FIG. 49 is an exploded perspective view of the watch of FIG. 37 in which the rotation module is at a fourth position relative to the case.
Figure 50:
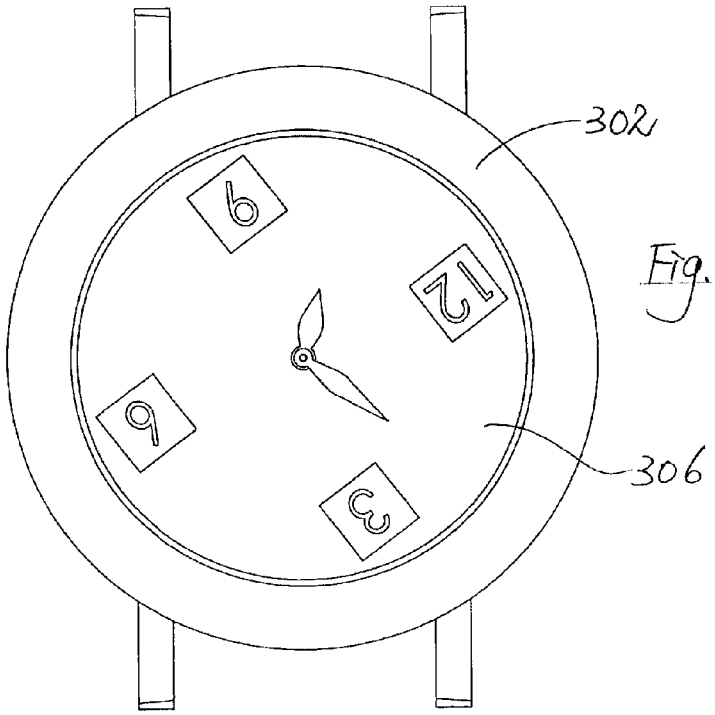
FIG. 50 is a top view of the watch of FIG. 49.
Figure 51:
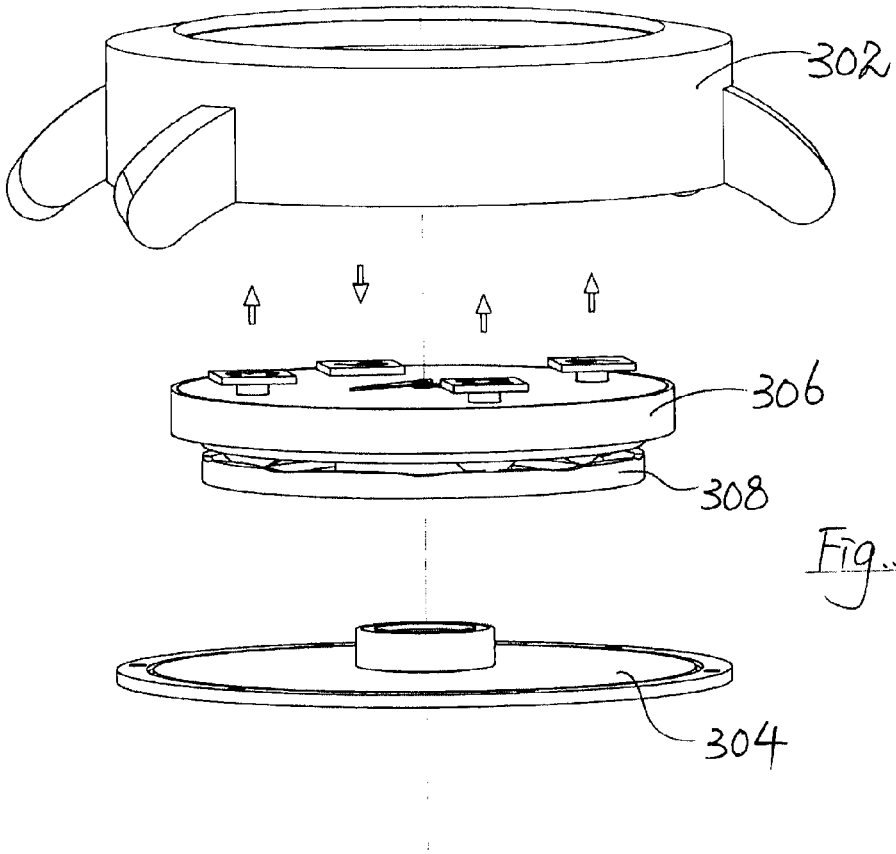
FIG. 51 is an exploded perspective view of the watch of FIG. 37 in which the rotation module is at a fifth position relative to the case.
Figure 52:
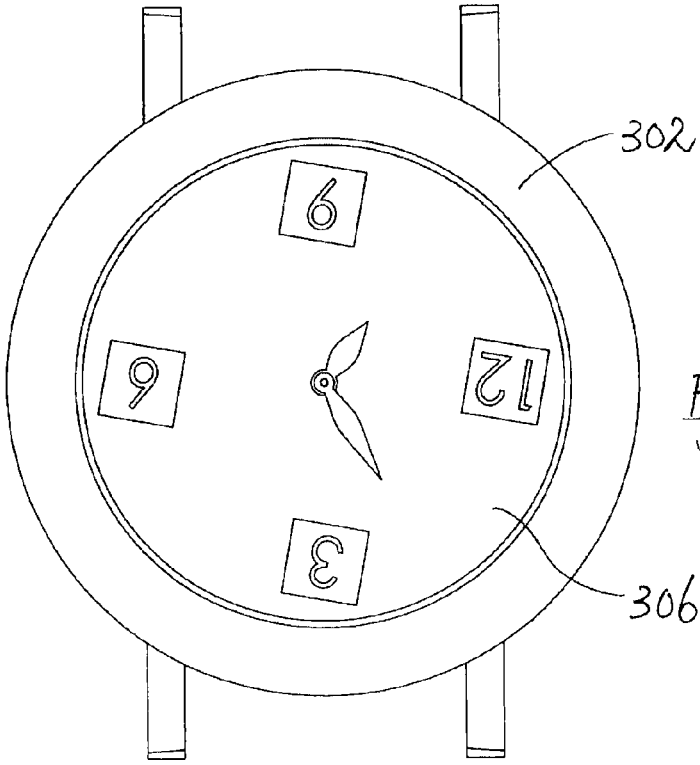
FIG. 52 is a top view of the watch of FIG. 51.
Figure 53:
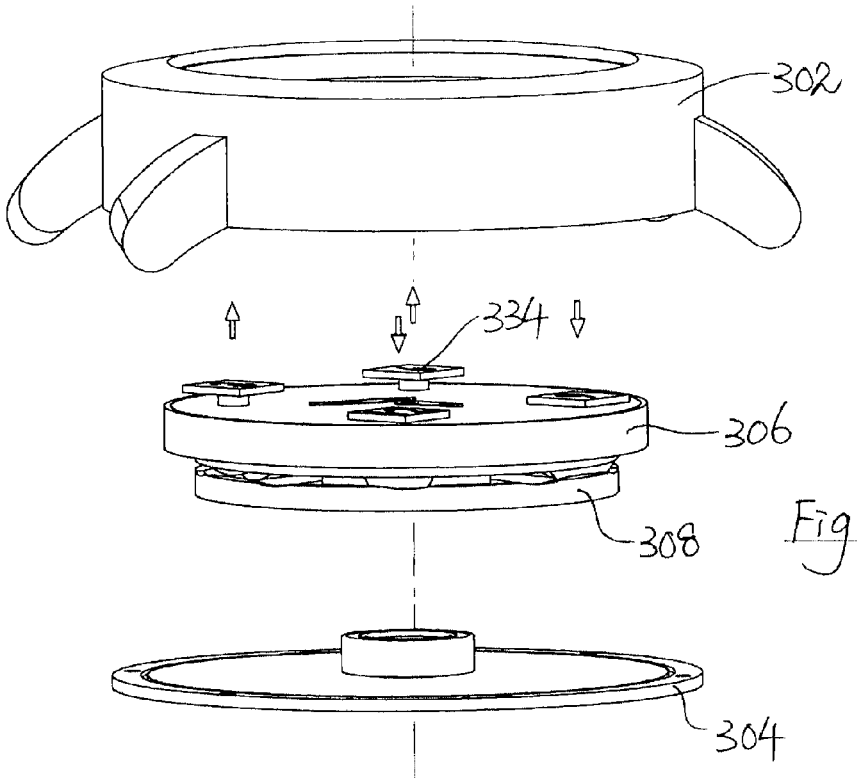
FIG. 53 is an exploded perspective view of the watch of FIG. 37 in which the rotation module is at a sixth position relative to the case.
Figure 54:
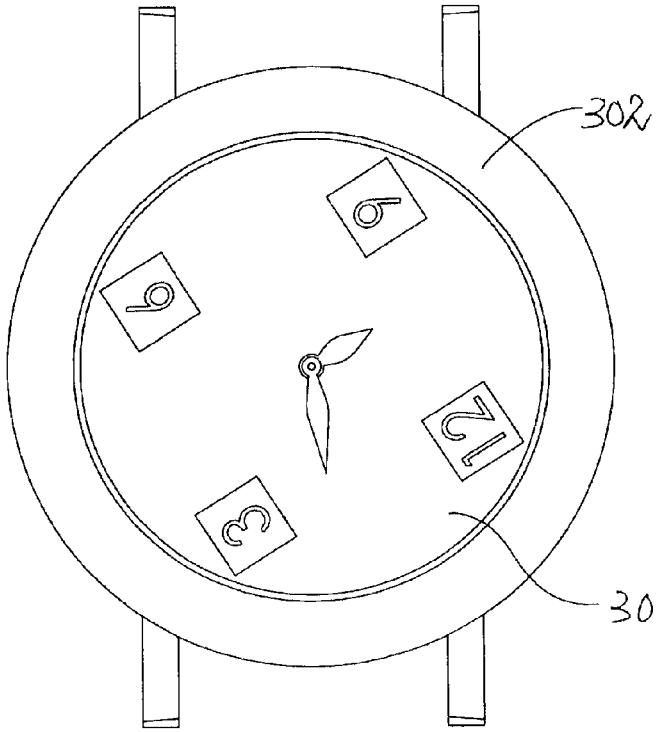
FIG. 54 is a top view of the watch of FIG. 53.
Figure 55:
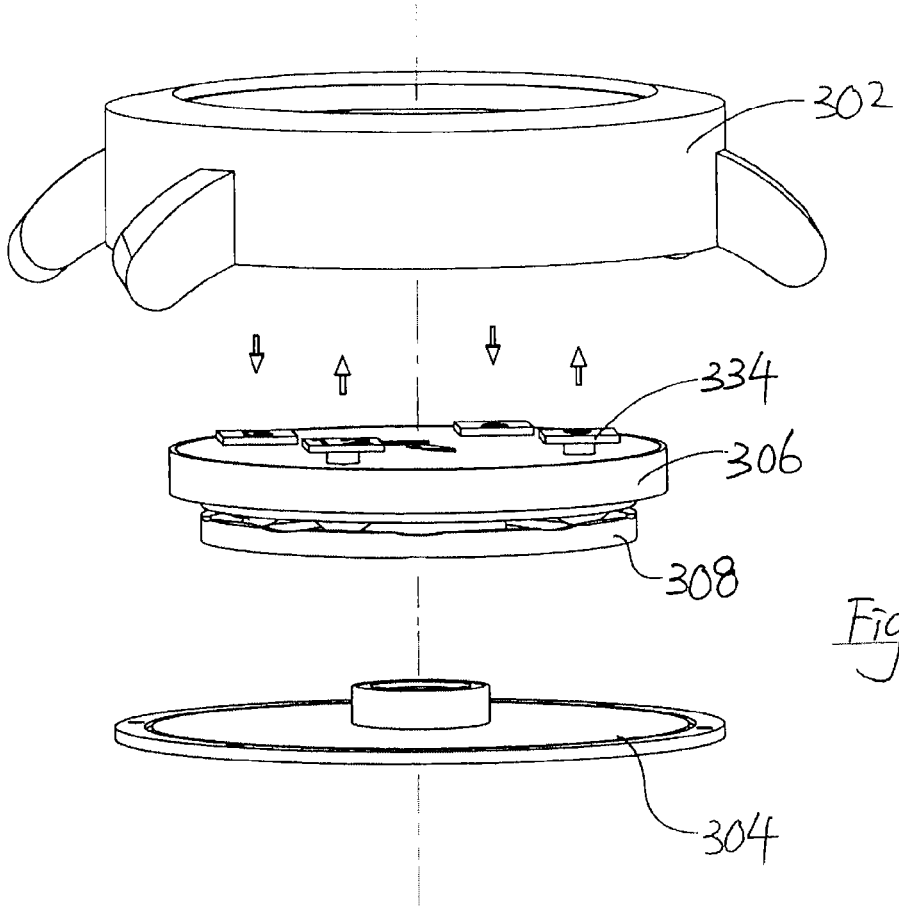
FIG. 55 is an exploded perspective view of the watch of FIG. 37 in which the rotation module is at a seventh position relative to the case.
Figure 56:
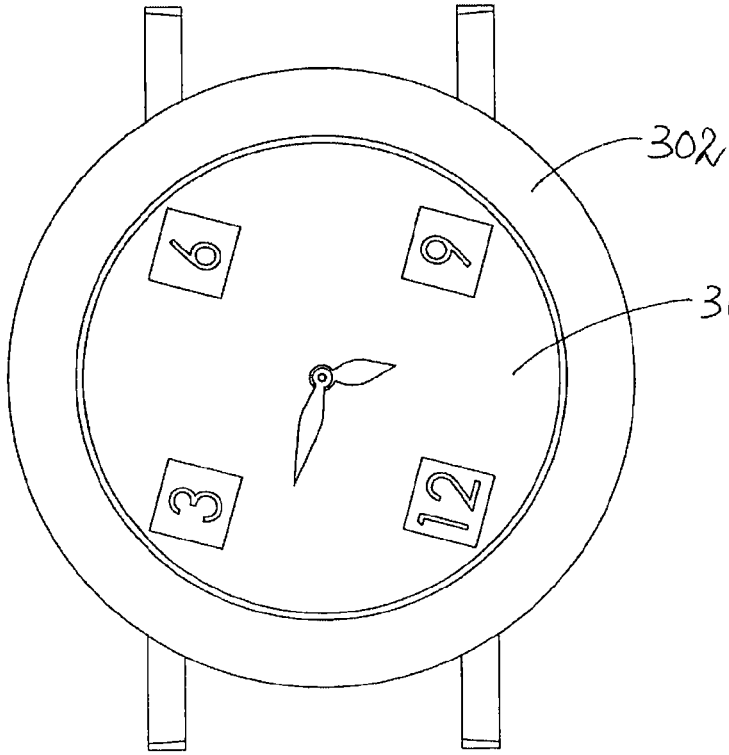
FIG. 56 is a top view of the watch of FIG. 55.

By way of such an arrangement, during rotation of the rotation module 306 relative to the watch case, the spherical parts 336 contact and travel on an undulating cam surface 348 of the cam 308. The spherical parts 336 will thus move to-and-fro along their respective longitudinal axis $P_{m1}$-$P_{m1}$, $P_{m2}$-$P_{m2}$, $P_{m3}$-$P_{m3}$, $P_{m4}$-$P_{m4}$ with the movement part 334 with which they are in engagement, to thereby cause the movement parts 334 to each move to-and-fro along their respective longitudinal axis $P_{m1}$-$P_{m1}$, $P_{m2}$-$P_{m2}$, $P_{m3}$-$P_{m3}$, $P_{m4}$-$P_{m4}$. In addition, during rotation of the rotation module 306 relative to the case body 302 from the position shown in FIG. 44, consecutively to the positions shown in FIG. 46, FIG. 48, FIG. 50, FIG. 52, FIG. 54, and subsequent FIG. 56, the spherical parts 336 also self-rotate relative to the rotation module 306 about their respective longitudinal axis $P_{m1}$-$P_{m1}$, $P_{m2}$-$P_{m2}$, $P_{m3}$-$P_{m3}$, $P_{m4}$-$P_{m4}$. This also causes the movement parts 334 to self-rotate relative to the rotation module 306 about their respective longitudinal axis $P_{m1}$-$P_{m1}$, $P_{m2}$-$P_{m2}$, $P_{m3}$-$P_{m3}$, $P_{m4}$-$P_{m4}$. It can thus be seen that, duration rotation of the rotation module 306 relative to the watch case, the movement parts 334 exhibit the following movements:

a. rotational movement relative to the case body 302 about the central longitudinal axis P-P of the rotation module 306;

b. to-and-fro movement relative to the rotation module 306 along their respective longitudinal axis $P_{m1}$-$P_{m1}$, $P_{m2}$-$P_{m2}$, $P_{m3}$-$P_{m3}$, $P_{m4}$-$P_{m4}$; and c. self-rotational movement relative to the rotation module 306 about their respective longitudinal axis $P_{m1}$-$P_{m1}$, $P_{m2}$-$P_{m2}$, $P_{m3}$-$P_{m3}$, $P_{ma}$-$P_{m4}$.

It should be pointed out that:

i. although the present invention has thus far been described in the context of watches, it should be readily understood that the invention may be realized in other forms of wearable articles, e.g. pocket watches, bracelets, rings, pendants, necklaces, and wrist bands;

ii. the above only illustrates examples whereby the present invention may be carried out, and that various modifications and/or alterations may be made thereto without departing from the spirit of the invention; and iii. certain features of the invention, which are, for clarity, described in the context of separate embodiments, may be provided in combination in a single embodiment. Conversely, various features of the invention which are, for brevity, described in the context of a single embodiment, may also be provided separately or in any appropriate sub-combinations.

What is claimed is:

1. A wearable article including:

a case, and a body with a longitudinal axis, wherein said body is contained within said case and is freely rotatable relative to said case about said longitudinal axis of said body, wherein said body includes at least one movement element, and wherein, upon rotation of said body relative to said case, said at least one movement element is movable to-and-fro along a path and relative to said body.

2. An article according to claim 1, wherein said path is substantially straight.

3. An article according to claim 2, wherein said path is substantially parallel to said longitudinal axis of said body.

4. An article according to claim 1, wherein said path is curved.

5. An article according to claim 1, wherein the centre of gravity of said body is offset from said longitudinal axis.

6. An article according to claim 5, wherein said body includes a weight which is offset from said longitudinal axis.

7. An article according to claim 1, further comprising a cam member with a cam surface, wherein said at least one movement element is engaged with said cam surface, and wherein upon rotation of said body relative to said case, said at least one movement element is movable relative to said cam surface.

8. An article according to claim 7, wherein said cam member is fixed relative to said case.

9. An article according to claim 7, wherein said cam surface includes at least one crest portion and at least one trough portion.

10. An article according to claim 9, wherein said cam surface includes a plurality of crest portions with intervening crest portions.

11. An article according to claim 10, wherein said cam surface is annular in shape.

12. An article according to claim 11, wherein said plurality of crest portions are equi-angularly disposed along said cam surface.

13. An article according to claim 1, wherein said body has an upper surface, and wherein said movement element is movable relative to said upper surface of said body between an upper position and a lower position.

14. An article according to claim 7, wherein said at least one movement element is engaged with said cam surface via at least one intermediate member.

15. An article according to claim 14, wherein said at least one intermediate member is in contact with said at least one movement element and said cam surface of said cam member.

16. An article according to claim 14, wherein said at least one intermediate member is substantially spherical in shape.

17. An article according to claim 14, wherein said intermediate member is rotatable relative to said body and relative to said at least one movement element.

18. An article according to claim 14, wherein said intermediate member is fixedly engaged with said at least one movement element for simultaneous movement.

19. An article according to claim 18, wherein said intermediate member is self-rotatable relative to said body about an axis of rotation.

20. An article according to claim 19, wherein said axis of rotation is substantially parallel to said longitudinal axis of said body.

21. An article according to claim 18, wherein said at least one movement element is self-rotatable relative to said body.

22. An article according to claim 1, wherein said body includes a plurality of said movement elements.

23. An article according to claim 22, wherein, during rotation of said body relative to said case, at least two of said plurality of movement elements are movable in a same direction each along a respective path.

24. An article according to claim 22, wherein, during rotation of said body relative to said case, at least two of said plurality of movement elements are movable in different directions each along a respective path.

25. An article according to claim 1, wherein said article is a watch.

26. An article according to claim 25, wherein said body includes a watch movement.

27. An article according to claim 25, wherein said at least one movement element is a numeral pad.

* * * * *